US006010819A

United States Patent [19]

Arakatsu et al.

[11] Patent Number: 6,010,819

[45] Date of Patent: Jan. 4, 2000

[54] METHOD FOR IMPROVING LIGHT FASTNESS OF IMAGES, AND IMAGE FORMING MATERIAL

[75] Inventors: Hiroshi Arakatsu; Nobuo Seto; Yoshisada Nakamura; Hironori Hiyoshi; Hiroyuki Watanabe; Takayoshi Kamio, all of Kanagawa, Japan

[73] Assignee: Fuji Photo Film., Ltd., Kanagawa, Japan

[21] Appl. No.: 09/138,670

[22] Filed: Aug. 24, 1998

[30] Foreign Application Priority Data

Aug. 22, 1997 [JP] Japan ..... 9-226700
Jul. 6, 1998 [JP] Japan ..... 10-190552

[51] Int. Cl.[7] ..... G03C 8/26; G03C 8/10; G03C 7/46

[52] U.S. Cl. ..... 430/216; 430/372; 430/551; 430/463; 430/490; 546/244; 546/245

[58] Field of Search ..... 430/216, 551, 430/372, 463, 490; 546/244, 245

[56] References Cited

U.S. PATENT DOCUMENTS

| | | | |
|---|---|---|---|
| 4,452,884 | 6/1984 | Leppard | 430/551 |
| 4,463,085 | 7/1984 | Mitsui et al. | 430/551 |
| 4,496,649 | 1/1985 | Leppard | 430/551 |
| 4,558,131 | 12/1985 | Leppard et al. | 430/551 |
| 4,740,445 | 4/1988 | Hirai et al. | 430/203 |
| 5,049,473 | 9/1991 | Furuya et al. | 430/216 |
| 5,068,172 | 11/1991 | Seto et al. | 430/551 |
| 5,219,724 | 6/1993 | Kato et al. | 430/551 |

FOREIGN PATENT DOCUMENTS

| | | | |
|---|---|---|---|
| 49-20974 | 5/1974 | Japan | G03C 7/00 |
| 62-144162 | 6/1987 | Japan | G03C 7/00 |
| 4-125559 | 4/1992 | Japan | G03C 8/40 |

OTHER PUBLICATIONS

"Photographic Processes and Products", *Research Disclosure* No. 15162, Nov. 1976, pp. 76–87.

*Primary Examiner*—Richard L. Schilling
*Attorney, Agent, or Firm*—Sughrue, Mion, Zinn, Macpeak & Seas, PLLC

[57] ABSTRACT

A method for improving light fastness of an image, which comprises releasing or forming an image forming dye or a precursor thereof corresponding or counter-corresponding to silver development and allowing an image formed by transferring said image forming dye or precursor thereof to coexist with a compound represented by general formula (I) in an image forming material (I)

The symbols in formula (I) are defined in the description. Also disclosed is an image forming material for use in the method.

18 Claims, No Drawings

METHOD FOR IMPROVING LIGHT FASTNESS OF IMAGES, AND IMAGE FORMING MATERIAL

FIELD OF THE INVENTION

This invention relates to a method for improving light fastness in a diffusion transfer image forming process in which a transfer image is formed by forming or releasing an image forming dye corresponding or counter-corresponding to silver development, and also relates to an image forming material for use in the method.

BACKGROUND OF THE INVENTION

A color diffusion transfer type photograph material (so-called instant photograph), a heat developing color diffusion transfer process, a method in which a photosensitive microcapsules are used and the like are known as the method in which an image forming dye is formed or released making use of a silver halide and an image is formed by transferring the dye.

Since the light resistance of images obtained by these methods is generally inferior to that of the images of usual photograph process, various methods have been proposed with the aim of improving the light resistance.

As one of these methods, an ultraviolet absorber is used. In such a method, the light resistance is improved by reducing the quantity of light to be irradiated upon a color image by the use of an ultraviolet absorber. This method can inhibit fading caused by ultraviolet light but has no effect on fading caused by visible light. It also has a disadvantage in that images fade and weather by the ultraviolet absorber.

In a secondary matter, it requires a relatively large amount of the ultraviolet absorber in order to improve the light resistance sufficiently. The use of a large amount of the ultraviolet absorber entails increment of coating thickness, thus resulting in various problems such as prolonged period of transfer time, reduction of resolution, aggravation of useful capacity and the like, as well as reduction of film strength and precipitation of the ultraviolet absorber.

In addition, this method cannot provide sufficient light resistance due to its fundamental problems such as reduction of fluorescent brightness, aggravation of brightness and the like.

Also, studies have been conducted on various fading inhibitors which are used in so-called conventional photograph system. However, even a fading inhibitor which is useful in the conventional photograph system cannot exert sufficient effects in the photograph method of the present invention in which an image is formed by transferring a dye.

JP-B-49-20974 (the term "JP-B" as used herein means an "examined Japanese patent publication") and JP-A-62-144162 (the term "JP-A" as used herein means an "unexamined published Japanese patent application") disclose the use of specified piperidine derivatives as fading inhibitors in image receiving materials (image receiving layer and the like) which are used in the color diffusion transfer process.

However, the light fading-inhibiting effect of the piperidine derivatives disclosed therein on transfer dye images is not sufficient so that further improvement is required.

In addition, JP-A-4-125559 disclose the addition of a specified piperidine derivative to an image receiving material (dye fixing element) which is used in the color diffusion transfer process, in order to inhibit changes in the density of white ground portions. However, the lipophilic piperidine derivative illustratively disclosed therein has insufficient light fading-inhibiting effect on transfer dye images.

SUMMARY OF THE INVENTION

It is, therefore, an object of the present invention to provide a method for improving the light resistance of transfer dye images in a process in which an image forming dye (or a precursor thereof) is released or formed corresponding or counter-corresponding to silver development and then an image is formed by transferring the dye.

Another object of the present invention is to provide an image forming material for use in the method.

Other objects and effects of the present invention will become apparent from the following description.

The objects of the present invention have been achieved by the following items (1) to (7).

(1) A method for improving light fastness of an image, which comprises releasing or forming an image forming dye or a precursor thereof corresponding or counter-corresponding to silver development and allowing an image formed by transferring said image forming dye or precursor thereof to coexist with a compound represented by general formula (I) in an image forming material (I)

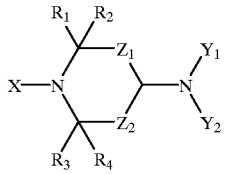

wherein X represents a hydrogen atom, a hydroxyl group, an aliphatic group, an oxyradical group, an acyl group, an aliphatic oxy group, an aliphatic oxycarbonyl group or an aryloxycarbonyl group, $Y_1$, and $Y_2$ may be the same or different from each other, each representing a hydrogen atom or a substituent group, or may form a five- or six-membered nitrogen-containing hetero ring by linking with each other, with the proviso that the substituent groups represented by $Y_1$ and $Y_2$ have such a size that the compound of formula (I) can disperse in a hydrophilic colloid medium and which can maintain appropriate hydrophilic property of said compound, $Z_1$ represents a single bond or a methylene or ethylene group which may have a substituent group, $Z_2$ represents a methylene group which may have a substituent group, and $R_1$, $R_2$, $R_3$ and $R_4$ may be the same or different from one another and each represents an aliphatic group wherein each of the combinations of $R_1$ and $R_2$ and $R_3$ and $R_4$ may form a five- or six-membered ring by linking with each other.

(2) An image forming material for use in a method in which an image forming dye or a precursor thereof is released or formed corresponding or counter-corresponding to silver development and an image is formed by transferring said dye image forming dye or precursor thereof, which comprises a fading inhibitor or a precursor thereof represented by general formula (I) as defined in the above item (1).

(3) A dye fixing element for use in a method in which an image forming dye or a precursor thereof is released or formed corresponding or counter-corresponding to silver development and an image is formed by transferring said image forming dye or precursor thereof, which comprises a fading inhibitor or a precursor thereof represented by general formula (I) as defined in the above item (1).

(4) The dye fixing element according to the above item (3), wherein the dye fixing element contains a polymer mordant.

(5) The dye fixing element according to the above item (4), wherein the polymer mordant contains 60 mol % or more of the unit represented by the following general formula (II):

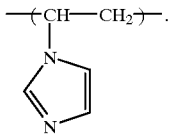

(6) A dye fixing element for use in a system in which a photosensitive element containing at least a photosensitive silver halide is imagewise exposed, and laminated, simultaneously with or after the imagewise exposure, with a dye fixing element comprising a separate support from that of the photosensitive element in the presence of at least one of a base and a base precursor together with a small amount of water, and the laminated elements are subjected to heat development to form a transfer dye image on the dye fixing element, which fixing element comprises a polymer mordant and a fading inhibitor or a precursor thereof represented by general formula (I) as defined in the above item (1).

(7) The dye fixing element according to any one of the above items (3) to (6), wherein the image forming dye is a phenol azo dye.

DETAILED DESCRIPTION OF THE INVENTION

The present inventors have considered as follows about the reason why the fading inhibitors useful in the conventional photograph system do not exert their effects in the dye transfer system as employed in the present invention. That is, since an image forming dye is used in the conventional photograph system by concealing it in the emulsified dispersion form in a high boiling point organic solvent (so-called oil protect), existing place of the dye is limited and a fading inhibitor can therefore be placed at a high density in the same oil drops containing the dye, so that sufficient fading-inhibiting effect can be obtained. On the contrary, it was considered that sufficient effect cannot be obtained in the system of the present invention, because the image forming dye is water-soluble and distributed broadly and thinly in the image fixing layer, and the fading inhibitor useful in the conventional photograph system is hardly soluble in water and cannot therefore undergo sufficient reaction with the image forming dye which is distributed broadly and thinly in the hydrophilic layer. In consequence, an attempt was made to add various fading inhibitors by making them into appropriately water-soluble state, to thereby find that light fastness can be improved markedly by the addition of a compound represented by general formula (I).

JP-A-4-125559 is an invention in which a piperidine derivative is used. This publication discloses a method in which changes in the density of white ground area are reduced by adding hindered amines to a dye fixing element. The effect of the present invention was completely unpredictable from this publication, because the compound of the present invention is not present in the illustrative compounds of said publication, the object of their addition is different from the present invention so that said publication does not disclose about improvement of light fastness and, still more, the illustrative compounds are oil-soluble in view of the fact that the compounds of said publication are intended to be used in the form of oil protect.

Also, as another invention which uses piperidine derivatives, JP-B-49-20974 discloses the use of hindered piperidines in a photosensitive material and also discloses that they are effective in the dye diffusion transfer process too. However, this publication is different from the present invention in view of the points that structure of the fading inhibitor is different from the inhibitor of the present invention and that the principal object of said publication seems to be the use of the compounds in a conventional system, because compounds hardly soluble in water are used as described in line 6 on page 137.

In addition, as still another invention which uses a piperidine derivative, JP-A-62-144162 discloses a fading inhibitor which exerts its effect even in the dye diffusion transfer system. This publication discloses a dye image receiving material which contains a compound similar to the present invention, to be used in a color diffusion transfer photograph, but is different from the compound of the present invention having appropriate dispersing ability, from the viewpoint that the fading inhibitor is made into non-dispersing type by linking the fading inhibitor with a bulky group which does not contain water-solubilizing groups.

The present inventors have examined the compound disclosed in the above publication and, as a result, found that fading-inhibiting effect on transfer dye images can be improved markedly by rather increasing water-solubility of the compound through the removal of the ballast group from the compound.

The following describes the compound for use in the present invention.

In general formula (I), the aliphatic group of X is an alkyl group having 20 or less, preferably 10 or less, carbon atoms, which may have a substituent group (for example, methyl, ethyl, 2-methanesulfonamidoethyl or the like group) or an alkenyl group having 20 or less, preferably 10 or less, carbon atoms, which may have a substituent group (for example, allyl, vinyl or the like group), the acyl group is an acyl group having 20 or less, preferably 10 or less, carbon atoms, which may have a substituent group (for example, acetyl, phenoxyacetyl or the like group), the aliphatic oxy group is an alkoxy group having 20 or less, preferably 10 or less, carbon atoms, which may have a substituent group (for example, methoxy, i-butoxy, 2-ethylhexyloxy, dodecyloxy or the like group) or an alkenoxy group having 20 or less, preferably 10 or less, carbon atoms, which may have a substituent group (for example, vinyloxy, allyloxy or the like group), the aliphatic oxycarbonyl group is an alkoxycarbonyl group having 20 or less, preferably 10 or less, carbon atoms, which may have a substituent group (for example, methoxycarbonyl, phenoxyethoxycarbonyl, dodecyloxycarbonyl or the like group) or an alkenoxycarbonyl group having 20 or less, preferably 10 or less, carbon atoms, which may have a substituent group (for example, allyloxycarbonyl or the like group) and the aryloxycarbonyl group is an aryloxycarbonyl group having 20 or less, preferably 10 or less, carbon atoms, which may have a substituent group (for example, phenoxycarbonyl, 4-methoxyphenoxycarbonyl, 3-chlorophenoxycarbonyl or the like group). $Y_1$ and $Y_2$ may be the same or different from each other and examples of the substituent group in $Y_1$ and $Y_2$ include substitutable groups (for example, an aliphatic group, an aryl group, a heterocyclic group, an acyl group, an aliphatic oxycarbonyl group, an aryloxycarbonyl group, a heterocyclic oxycarbonyl group, carbamoyl group, sulfamoylcarbamoyl group, an aliphatic sulfonyl group, an arylsulfonyl group, a heterocyclic sulfonyl group, sulfamoyl group, phosphoryl group, phosphonyl group and the like), or they may be linked with each other to form a five- or six-membered ring (for example, morpholine, pyrrolidine or the like). However, $Y_1$ and $Y_2$ are groups which have such a size that said compound can disperse in a hydrophilic colloid medium and which can maintain appropriate hydrophilic property of said compound. $Z_1$ is a single bond or methylene or ethylene group which may have a substituent group (such as an alkyl group) and $Z_2$ is methylene group which may have a substituent group (such as an alkyl group). $R_1$, $R_2$, $R_3$ and $R_4$ may be the same or different from one another and each represents an aliphatic group (an alkyl group having 10 or less, preferably 5 or less, carbon atoms, which may have a substituent group, and its examples include methyl, ethyl, propyl and the like groups). In this case, each of the combinations of $R_1$ and $R_2$ and $R_3$ and $R_4$ may form a five- or six-membered ring (such as cyclohexane ring) by linking with each other.

From the viewpoint of the effect of the present invention, X is preferably hydrogen atom, hydroxyl group, an aliphatic group or an aliphatic oxy group, more preferably hydrogen atom or an aliphatic group, most preferably hydrogen atom. From the viewpoint of the effect of the present invention, when each of $Y_1$ and $Y_2$ contains an aliphatic group moiety, it is desirable that one hydrocarbon group of the aliphatic group moieties has 4 or less carbon atoms and, when the total number of carbon atoms of said aliphatic group moieties is 4 or more, it contains a hetero atom-containing substituent group as a linking group and one hydrocarbon group has 4 or less carbon atoms. A case in which one of $Y_1$ and $Y_2$ is hydrogen atom is preferred, a case in which $Y_1$ is hydrogen atom and $Y_2$ is an acyl group, an aliphatic oxycarbonyl group, an aryloxycarbonyl group, carbamoyl group, sulfamoylcarbamoyl group, an aliphatic sulfonyl group, an arylsulfonyl group, sulfamoyl group, phosphoryl group or phosphonyl group is more preferred, and a case in which $Y_1$ is hydrogen atom and $Y_2$ is an acyl group, an aliphatic oxycarbonyl group, carbamoyl group, an aliphatic sulfonyl group, sulfamoyl group, phosphoryl group or phosphonyl group is most preferred. From the viewpoint of the effect of the present invention, it is desirable that each of $Z_1$ and $Z_2$ is a single bond or methylene group and the nitrogen-containing hetero ring formed by $Z_1$, $Z_2$ and the like is a five-membered or six-membered ring, and it is more desirable that each of $Z_1$, and $Z_2$ is unsubstituted methylene group and the ring formed by $Z_1$, $Z_2$ and the like is a six-membered ring. From the viewpoint of the effect of the present invention, it is particularly desirable that all of $R_1$, $R_2$, $R_3$ and R are methyl group.

Next, preferred structures of general formula (I) of the present invention are described.

From the viewpoint of the effect of the present invention, compounds represented by the following general formulae (I-1) and (I-2) are desirable.

General Formula (I-1)

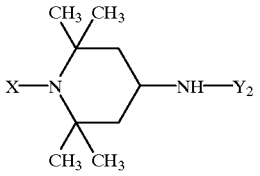

-continued

General Formula (I-2)

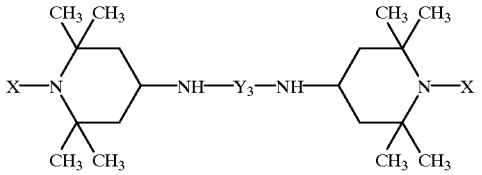

In the above formulae, X and $Y_2$ are as defined in general formula (I). $Y_3$ is a single bond or a divalent group (sulfonyl group; carbonyl group; phosphoryl group; phosphonyl group; a divalent acyl group which may have a substituent group and have preferably 10 or less, more preferably 6 or less, carbon atoms, such as oxalyl group, malonyl group, succinyl group, glutalyl group, adipoyl group, diglycolyl group or —$CO(CH_2CH_2O)_{1-3}CH_2CH_2CO$—; or a divalent sulfonyl group which may have a substituent group and have preferably 10 or less, more preferably 4 or less, carbon atoms, such as 1,2-ethanedisulfonyl group). When each of $Y_2$ and $Y_3$ in the formulae contains an aliphatic group moiety, it is desirable that one hydrocarbon group of the aliphatic group moieties has 4 or less carbon atoms and, when the total number of carbon atoms of the aliphatic group moieties is 4 or more, it contains a hetero atom-containing substituent group as a linking group and one hydrocarbon group has 4 or less carbon atoms. From the viewpoint of the effect of the present invention, a case in which the total number of carbon atoms of the aliphatic group moieties of $Y_2$ and $Y_3$ is 4 or less is more desirable.

From the viewpoint of the effect of the present invention, in general formula (I-1) or (I-2), a case in which X is hydrogen atom and $Y_2$ is an acyl group, an alkylsulfonyl group, phosphoryl group or phosphonyl group or $Y_3$ is a divalent acyl group, phosphoryl group or phosphonyl group is desirable, and a case in which X is hydrogen atom and $Y_2$ is an alkylsulfonyl group or $Y_3$ is a divalent acyl group is more desirable. A compound represented by general formula (I-2) is most desirable from the viewpoint of the effect of the present invention. In that case, when each of $Y_2$ and $Y_3$ contains an aliphatic group moiety, it is desirable that one hydrocarbon group of the aliphatic group moieties has 4 or less carbon atoms and, when the total number of carbon atoms of the aliphatic group moieties is 4 or more, it contains a hetero atom-containing substituent group as a linking group and one hydrocarbon group has 4 or less carbon atoms. A case in which the total number of carbon atoms of the aliphatic group moieties of $Y_2$ and $Y_3$ is 4 or less is more desirable.

Illustrative examples of the compound of the present invention represented by general formula (I) are shown in the following, though the invention is not restricted thereby.

TABLE 1

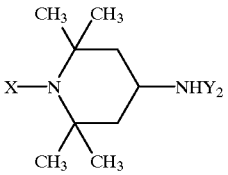

| No | X | $Y^2$ |
|---|---|---|
| a-1 | H | H |
| a-2 | H | 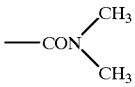 |
| a-3 | H | —$CONC_3H_7$(n) |
| a-4 | H | —$CONHC_2H_5$ |
| a-5 | H | 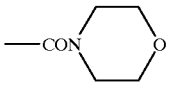 |
| a-6 | H | 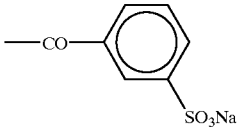 |
| a-7 | H | —$COCH_2OH$ |
| a-8 | H | —$COCH_2OCOCH_3$ |
| a-9 | H | —$COCH_3$ |
| a-10 | H | —$SO_2CH_3$ |
| a-11 | H | —$COCH_2OCH_3$ |
| a-12 | H | —$COOCH_3$ |
| a-13 | H | —$COC_2H_5$ |
| a-14 | H | —$SO_2NHC_2H_5$ |
| a-15 | H | 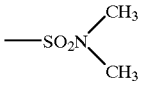 |
| a-16 | —OH | —$COCH_3$ |
| a-17 | —$OC_8H_{17}$(n) | —$SO_2CH_3$ |
| a-18 | —$OCH_3$ | —$SO_2CH_3$ |
| a-19 | —$COCH_3$ | —$COCH_3$ |
| a-20 | —$COOCH_3$ | —$COOCH_3$ |
| a-21 | 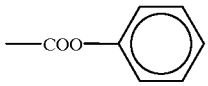 | 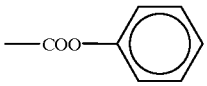 |
| a-22 | —$CH_3$ | —$COOC_2H_5$ |
| a-23 | —$C_2H_5$ | —$COCH_2OH$ |
| a-24 | —$CH_3$ | 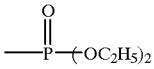 |
| a-25 | —O | —$NHSO_2CH_3$ |
| a-26 | H | —$SO_2C_2H_5$ |
| a-27 | H | —$SO_2C_4H_9$(n) |
| a-28 | H | 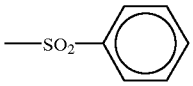 |

TABLE 1-continued

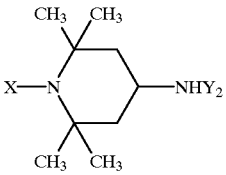

| No | X | $Y^2$ |
|---|---|---|
| a-29 | H | 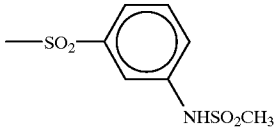 |
| a-30 | H | —$CONHC^3H_7$(i) |
| a-31 | H | —$CONHC_4H_9$(n) |
| a-32 | H | 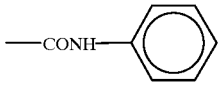 |
| a-33 | H | 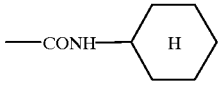 |
| a-34 | H | 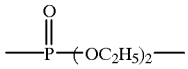 |
| a-35 | H | 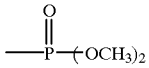 |
| a-36 | H | —$SO_2CH_2OH$ |
| a-37 | H | —$SO_2CH_2Cl$ |
| a-38 | H | —$C_4H_8$—$SO_3Na$ |
| a-39 | —$CH_3$ | 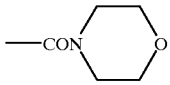 |
| a-40 | —$C_4H_9$(n) | 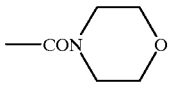 |
| a-41 | H | —$CH_3$ |
| a-42 | H | 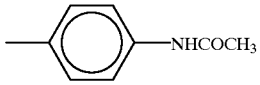 |
| a-43 | H | 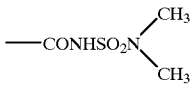 |
| a-44 | H | 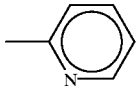 |

TABLE 1-continued
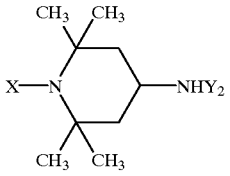
| No | X | $Y^2$ |
|---|---|---|
| a-45 | H | 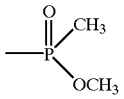 |
| a-46 | H | 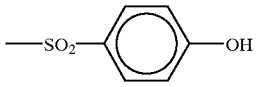 |
| a-47 | H | $—SO^2CH_2OCH_3$ |
TABLE 1-continued
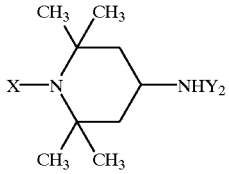
| No | X | $Y^2$ |
|---|---|---|
| a-48 | H | $—COCH_2CH_2OH$ |
| a-49 | H | 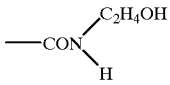 |
| a-50 | H | 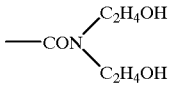 |
TABLE 2
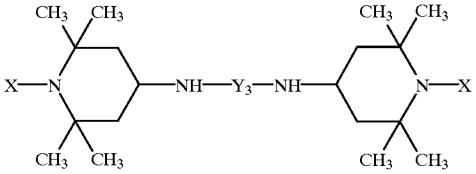
| No | X | $Y_3$ |
|---|---|---|
| a-51 | H | 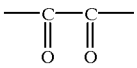 |
| a-52 | H | 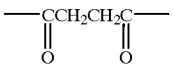 |
| a-53 | H | 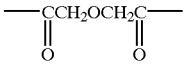 |
| a-54 | H | 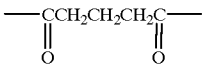 |
| a-55 | M | 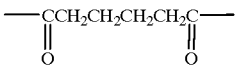 |
| a-56 | H | 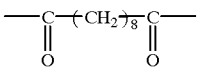 |
| a-57 | H | 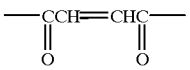 (Trans) |
| a-58 | H | 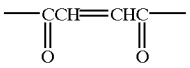 (Cis) |

TABLE 2-continued
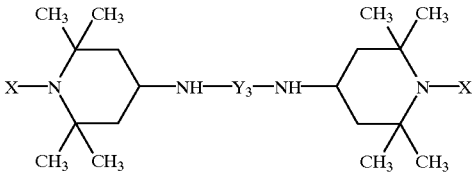
| No | X | $Y_3$ |
|---|---|---|
| a-59 | H | 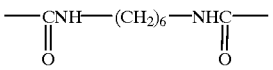 |
| a-60 | H | 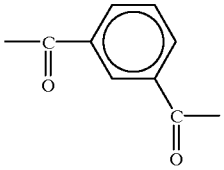 |
| a-61 | H | 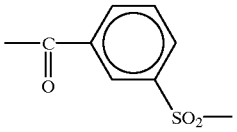 |
| a-62 | H | 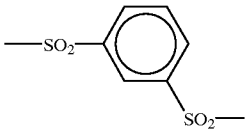 |
| a-63 | H | 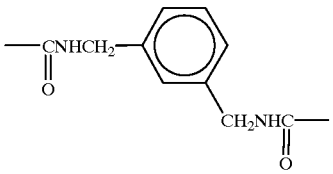 |
| a-64 | H | 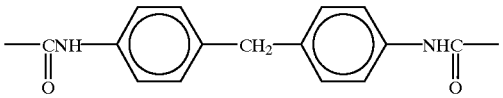 |
| a-65 | H | 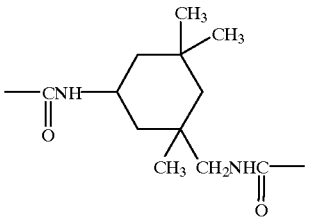 |
| a-66 | H | 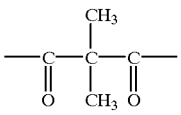 |
| a-67 | H | $—SO_2CH_2CH_2—SO_2—$ |

TABLE 2-continued
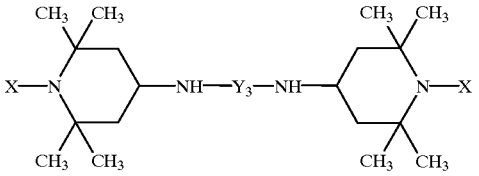
| No | X | $Y_3$ |
|---|---|---|
| a-68 | H | 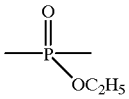 |
| a-69 | H | 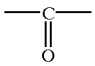 |
| a-70 | H | 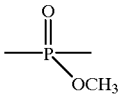 |
| a-71 | H | 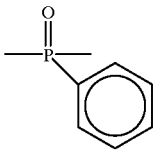 |
| a-72 | H | 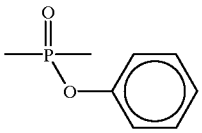 |
| a-73 | H | 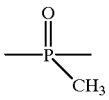 |
| a-74 | $CH_3$ | 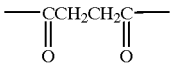 |
| a-75 | $CH_3$ | 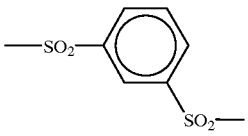 |
| a-76 | $CH_3$ | $—SO_2CH_2CH_2SO_2—$ |
| a-77 | $CH_3$ | 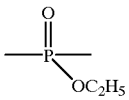 |

TABLE 2-continued
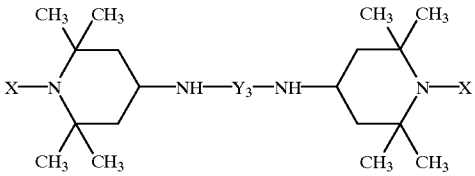
| No | X | $Y_3$ |
|---|---|---|
| a-78 | $CH_3$ | 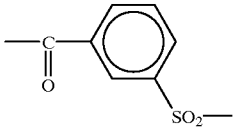 |
| a-79 | H | 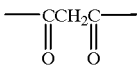 |
| a-80 | $CH_3$ | $—SO_2—$ |
| a-81 | $—COCH_3$ | 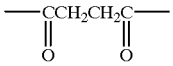 |
(a-82)
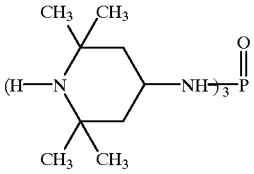
(a-83)
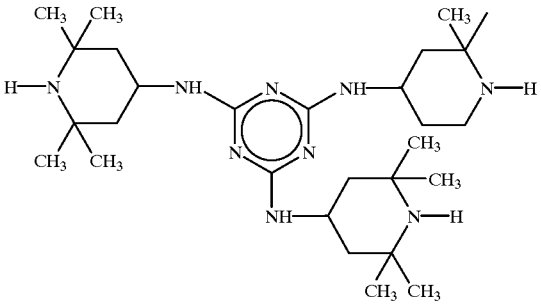
(a-84)
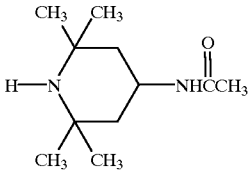
-continued
(a-85)
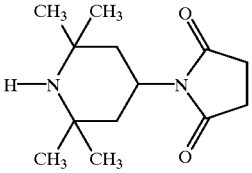
(a-86)
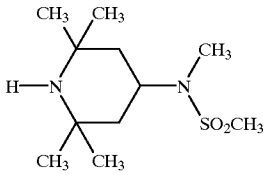
(a-87)
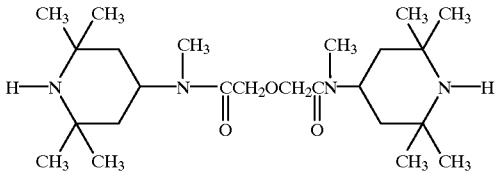
(a-88)
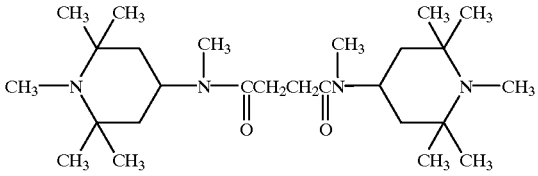

-continued (a-89)

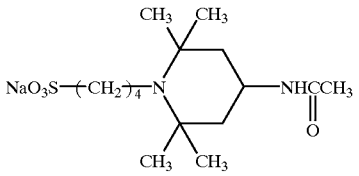

(a-90)

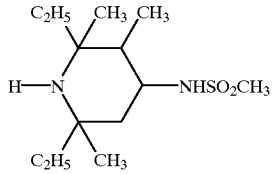

(a-91)

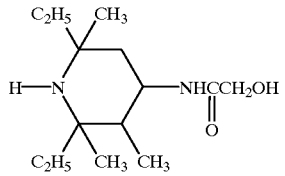

(a-92)

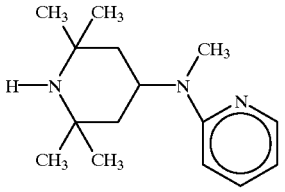

(a-93)

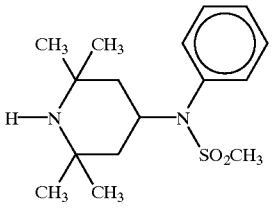

(a-94)

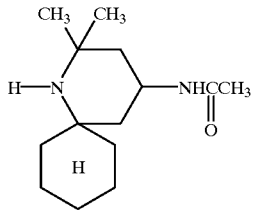

(a-95)

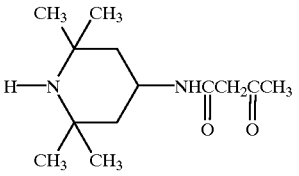

-continued (a-96)

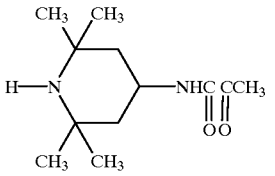

(a-97)

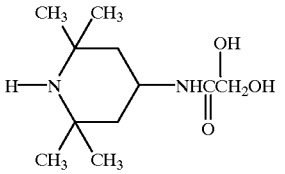

Next, a method for the synthesis of a typical compound of the present invention represented by general formula (I) is described below.

Synthesis of (a-53)

A 46.8 g (0.300 mol) portion of 4-amino-2,2,6,6-tetramethylpiperidine was dissolved in 130 ml of dimethylformamide, and 25 g (0.146 mol) of diglycolyl chloride was added dropwise to the thus prepared solution which was stirred at 8° C., spending 20 minutes. In this case, increase in temperature was controlled up to 20° C. in an ice bath. After the dropwise addition, this was stirred at 20° C. for 30 minutes and then mixed with 40 ml of acetonitrile. The thus precipitated crystals were collected by filtration and washed with 100 ml of acetonitrile. The yield was 75 g.

Separately from this, 16 g of potassium hydroxide was dissolved in 300 ml of methanol and stirred at 25° C. while the thus obtained crystals were added thereto. Methanol was evaporated under a reduced pressure, the thus obtained residue was dissolved in 300 ml of chloroform (crystals of potassium hydroxide were not dissolved) and the resulting solution was then dried by adding magnesium sulfate. After removal of magnesium sulfate by filtration, chloroform was evaporated and the thus obtained residue was dissolved under heating in 300 ml of acetonitrile which was then cooled. The crystals thus precipitated were collected by filtration and washed with 100 ml of cold acetonitrile and then the thus obtained crystals were dried. The compound of interest was obtained in an amount of 38.8 g with a yield of 63%, and its melting point was found to be 122 to 124° C.

Other compounds of the present invention can also be synthesized in a similar manner.

The term "image forming material" as used herein means all materials concerned in forming images, such as a photosensitive element, a dye fixing element and a processing solution (alkali processing composition), a processing sheet and the like processing elements.

The adding position of the fading inhibitor of the present invention represented by general formula (I) is described below. The fading inhibitor of the present invention may be present in the same layer of a transfer image forming dye when an image is finally formed, and, with regard to its adding position, the fading inhibitor of the present invention may be added to any position where it can be migrated into the image fixing layer during or after formation of the image. Also, it may be added to a single position or a plurality of positions. That is, it can be added to any optional position of the image forming material, illustratively, it can be added to an optional position of the dye fixing element, an optional position of the photosensitive element or any of the processing elements. In a photosensitive microcapsule system, it may be included in capsules or added to a binder in which capsules are dispersed and immobilized. Alternatively, it may be added to the dye fixing element after formation of an image. In other words, the fading inhibitor can be added to the dye fixing element by (1) coating a solution of the fading solution on the fixing element, (2) soaking the element in the fading inhibitor solution, (3) transferring the inhibitor from a processing sheet containing the same onto the element or (4) spraying the fading inhibitor solution on the element, as like the ink of an ink jet printer.

With regard to the method for the addition of the fading inhibitor of the present invention, it may be added by dissolving it in water or, if it does not separate when added to a coating solution, by dissolving it in an alcohol, a ketone or the like organic solvent or its mixture with water. It can also be added by dissolving it in an acid or a base. Alternatively, it may be added by including it in an inclusion compound.

The fading inhibitor of the present invention may be added as a single fading inhibitor or as a combination of a plurality of fading inhibitors. The total amount of the fading inhibitor of the present invention to be added is such that it is present in the dye fixing element in an amount of preferably 1 mmol/$m^2$ or more, more preferably within the range of from 2 mmol/$m^2$ to 20 mmol/$m^2$, after the image is finally formed.

The fading inhibitor of the present invention can be used in combination with other fading inhibitors.

Also, the fading inhibitor of the present invention can be used in combination with other fading inhibition method such as the addition of an ultraviolet absorber or the lamination of the surface of the dye fixing element with a resin through which oxygen does not substantially permeate.

In addition, the fading inhibitor of the present invention can be used in combination with a compound which generates active oxygen. Examples of the active oxygen generator include a certain image forming dye (such as a phenol azo dye), titanium oxide, a fluorescent brightener, an ultraviolet absorber, a transition metal salt and the like.

The dye fixing material for use in the present invention has on its support a layer which fixes at least an image-forming dye, and a mordant, a metal salt, an ink absorber and the like raw materials are added to the dye fixing layer depending on the fixing method of the dye. If necessary, a surface protecting layer, a timing layer and an acid neutralizing layer may be arranged, and a binder, a base generating agent, a heat dissolving agent, a brightener, an anti-fogging agent, a stabilizing agent, a hardening agent, a plasticizer, a high boiling point organic solvent, a coating auxiliary, a surface active agent, an anti-static agent, a mat, a lubricant, an antioxidant and the like may be contained therein.

With regard to the mordant, polymer mordants are preferably used, of which a polymer mordant containing a structural unit represented by the aforementioned general formula (II) is particularly preferred. It may preferably contain the structural unit represented by the aforementioned general formula (II) in an amount of 60 mol % or more.

Its illustrative examples include a dye fixing element described in JP-A-8-304982, a dye image receiving material described in JP-A-9-5968, an image receiving material described in JP-A-9-34081, an image receiving element described in Japanese Patent Application No. 8-316885 and an image receiving element (dye fixing element) described in JP-A-9-152705, and more preferred mode of practice are also described in these publications.

The photosensitive material for use in the present invention basically has a photosensitive silver halide, a binder and a dye donating compound and, as occasion demands, it may further contain a chemical sensitizer, a sensitivity increasing agent, a color sensitizer, a supersensitizer, a brightener, an anti-fogging agent, a stabilizing agent, a light absorber, a filter dye, a hardening agent, a base generating agent, a plasticizer, a high boiling point organic solvent, a coating auxiliary, a surface active agent, an anti-static agent, a mat and the like.

Its illustrative examples include a heat developing color photosensitive material described in JP-A-9-15805, a diffusion transfer silver halide photosensitive material described in JP-A-9-152705, a color photosensitive material described in JP-A-9-90582, a heat developing color photosensitive material described in JP-A-9-34081 and a color diffusion transfer photosensitive material described in Japanese Patent Application No. 8-316885, and more preferred mode of practice are also described in these publications.

As occasion demands, an alkali processing composition can be used in the present invention. The alkali processing composition is uniformly developed between a photosensitive element and an image receiving element after exposure of the photosensitive element to effect development of the photosensitive layer and contains an alkali and a developer as occasion further demands, as well as a thickener, a development accelerator, a development inhibitor, an antioxidant and the like as occasion demands still more. Illustratively, the processing composition described in Japanese Patent Application No. 8-316885 corresponds thereto, and more preferred mode of practice is also described in this patent.

With regard to the support of the photosensitive material and dye fixing material of the present invention, paper, synthetic high polymer (film) and the like supports for photograph use described on page 223 to 240 in "Fundamentals of Photography Technology-Silver Salt Photography", edited by The Society of Electrophotography of Japan, published by Corona (1979) can be exemplified. Their illustrative examples include polyethylene terephthalate, polyethylene naphthalate, polycarbonate, polyvinyl chloride, polystyrene, polypropylene, polyimide and celluloses (triacetyl cellulose for example) or these films further containing titanium oxide and the like pigments, as well as film method synthetic paper prepared from polypropylene and the like, mixed paper prepared from synthetic resin pulp and natural pulp, Yankee paper, baryta paper, coated paper (particularly cast-coated paper), a metal, fabrics, glasses, ceramics and the like.

These supports may be used alone or by laminating their one side or both sides with polyethylene, PET, polyester, polystyrene and the like synthetic high polymer.

In addition to the above, supports described for example in JP-A-62-253159 (pp. 29–31), JP-A-1-161236 (pp. 14–17), JP-A-63-316848, JP-A-2-22651, JP-A-3-56955 and U.S. Pat. No. 5,001,033 can also be used.

The surface of these supports may be coated with a hydrophilic binder and alumina sol, tin oxide or the like semi-conductive metal oxide or with carbon black and other anti-static agents.

Also, in order to improve wettability of coating solution and adhesive property of coat film and support, it is desirable to coat gelatin, PVA or the like polymer on the surface of these support in advance.

Thickness of the support may vary depending on the purpose of its use but is generally 40 $\mu$m or more and 400

μm or less. However, in the case of a method in which an image is formed using an element coated on two or more separate supports, a support having a thinner thickness (5 μm or more and 250 μm or less) than the just described thickness is preferably used as a support side which does not finally use the image on the element. As such a thin support, a film in which aluminum is deposited on PET may be used.

When the requirement for heat resistance and curling characteristics is particularly strict, supports described for example in JP-A-6-41281, JP-A-6-43581, JP-A-6-51426, JP-A-6-51437, JP-A-51442, JP-A-6-82961, JP-A-6-82960, JP-A-6-82959, JP-A-6-67346, JP-A-6-202277, JP-A-6-175282, JP-A-6-118561, JP-A-7-219129 and JP-A-7-219144 may be used preferably as the support for photosensitive material use.

Examples of the method for recording images on the photosensitive material by means of exposure include a method in which a scene, a person or the like is directly photographed using a camera or the like, a method in which exposure is effected through a reversal film or a negative film using a printer or an enlarger, a method in which scanning exposure of an original picture is effected through a slit or the like using the exposure device of a copier, a method in which exposure is effected by the emission of a light emitting diode, a laser or the like via electric signals of image information and a method in which image information is outputted from an image display apparatus such as a CRT, a liquid crystal display, an electroluminescence display, a plasma display or the like and exposed directly or via an optical system.

With regard to the light source for recording images on the photosensitive material, as described above, natural light, a tungsten lamp, a light emitting diode, a laser light source, CRT light source and the like light sources and exposure method disclosed in U.S. Pat. No. 4,500,626, JP-A-2-53378 and JP-A-2-54672 can be used.

Also useful is a light source in which a blue light emitting diode whose recent development is remarkable is combined with a green light emitting diode and a red light emitting diode. Particularly, the exposure apparatuses described in JP-A-7-140567, JP-A-7-248549, JP-A-7-248541, JP-A-7-295115, JP-A-7-290760, JP-A-7-301868, JP-A-7-301869, JP-A-7-306481 and JP-A-8-15788 can be used desirably.

In addition, imagewise exposure can also be effected using a wavelength converting element in which a non-linear optical material is combined with a laser light or the like coherent light source. In this case, the non-linear optical material is a material which can create non-linear property between the polarization and electrical field that are generated when a laser light or the like strong light electrical field is applied, and its preferred examples include lithium niobate, potassium dihydrogenphosphate (KDP), lithium iodate, $BaB_2O_4$ and the like inorganic compounds, a urea derivative, a nitroaniline derivative, a nitropyridine-N-oxide derivative such as 3-methyl-4-nitropyridine-N-oxide (POM) and the compounds described in JP-A-61-53462and JP-A-62-210432. As the mode of the wave length sensing element, a monocrystal light wave-guiding channel type, a fiber type and the like are known and can be used.

Also, useful examples of the aforementioned image information include image signals obtained from a video camera, electronic still camera and the like, television signals typified by the Nippon Television Signal Standard (NTSC), image signals obtained by dividing an original picture into a large number of picture elements using a scanner and the like and image signals prepared using CG, CAD and the like computers.

The image forming material (photosensitive material and/or dye fixing element) of the present invention can be used in various applications. For example, a dye fixing element after heat developing transfer can be used as a positive or negative color print material. Also, a photosensitive material in which a black dye donor and yellow, magenta and cyan dye donors are mixed can be used as a black-and-white positive or negative print material, a lithographic sensitive material or the like printing material or an X-ray photographing material. When the image forming material of the present invention is used particularly as a material for the printing of images from a photographing material, it is desirable to prepare a print on the dye fixing element of the present invention by means of heat developing transfer by exposing the photosensitive material of the present invention using a photographing material having information recording capacity as described in JP-A-6-163450 and JP-A-4-338944. As such a printing method, the methods disclosed in JP-A-5-241251, JP-A-5-19364 and 5-19363 can be used. In addition, the photosensitive material after heat developing transfer can be used as a photographing material by optionally subjecting it to desilverizing treatment. In that case, it is desirable to record photograph information and the like using the support having a magnetic substance layer described in JP-A-4-124645, JP-A-5-40321, JP-A-6-35092 and JP-A-6-317875.

The photosensitive material and/or dye fixing element of the present invention may have a conductive heat generator layer as a heating means for the heat developing and diffusion transfer of the dye. In that case, an element described for example in JP-A-61-145544 may be used as the heat generator element.

The heating temperature at the heat developing step is approximately from about 50° C. to 250° C., but a temperature of approximately from 60° C. to 180° C. is particularly effective. The diffusion transfer step of the dye may be carried out simultaneously with the heat developing or after completion of the heat developing step. In the latter case, the heating temperature for the transfer step may be within the range of from the temperature of the heat developing step to room temperature, but a temperature of from 50° C. to a temperature about 10° C.-lower than the temperature of the heat developing step is particularly desirable.

Though the migration of dyes occurs by heat alone, a solvent may be used in order to accelerate the dye migration. Also useful is a method described for example in U.S. Pat. No. 4,704,345, U.S. Pat. No. 4,740,445 and JP-A-61-238056, in which the development and transfer are carried out simultaneously or continuously by heating in the presence of a small amount of a solvent (particularly water). In this method, the heating temperature is preferably within the range of from 50° C. to boiling point of the solvent used, for example, within the range of from 50° C. to 100° C. when the solvent is water.

Examples of the solvent to be used for the acceleration of development and/or diffusion transfer of dyes include water, a basic aqueous solution containing an inorganic alkali metal salt or an organic base (examples of such a base are as described in the foregoing in relation to the image formation accelerator), a low boiling point solvent and a mixed solution of a low boiling point solvent with water or the just described basic aqueous solution. In addition, the solvent may contain a surface active agent, an anti-fogging agent, a complex compound formed with a hardly soluble metal salt, an antifungal agent and an antibacterial agent.

Water is preferably used as the solvent to be used in these heat developing and diffusion transfer steps, and any generally used water can be used as the water of this case. Its illustrative examples include distilled water, tap water, well water, mineral water and the like. In addition, water may be used once or repeatedly by its circulation in a heat developing apparatus which uses the image forming material (photosensitive material and image receiving element) of the present invention. In the latter case, water which contains components eluted from the material is used. The apparatus and water disclosed for example in JP-A-63-144354, JP-A-63-144355, JP-A-62-38460 and JP-A-3-210555 may also be used.

These solvents may be used by adding to the photosensitive material, the dye fixing element or both of them. The amount to be used may be equal to or less than the weight of solvent equivalent to the maximum swelling volume of the total coat film.

With regard to the water-adding method, the methods described for example in JP-A-62-253159 (page 5) and JP-A-63-85544 can be used preferably. Alternatively, the solvent may be used by filling it in microcapsules or including it in the photosensitive material, the dye fixing element or both of them in advance in the form of a hydrate.

The temperature of water to be added may be within the range of from 30° C. to 60° C. as described in the aforementioned JP-A-63-85544 and the like publications.

Also, in order to accelerate dye migration, a method may be employed in which a hydrophilic heat dissolving agent which is solid at ordinary temperature but dissolves at a high temperature is included in the photosensitive material and/or dye fixing element. The including layer may be any one of the photosensitive silver halide emulsion layer, middle layer, protective layer and dye fixing layer, but the dye fixing layer and/or its adjacent layer may be desirable.

Examples of the hydrophilic heat dissolving agent include ureas, pyridines, amides, sulfonamides, imides, alcohols, oximes and other heterocyclic compounds.

Examples of the heating method in the development and/or transfer step include a method in which the material is contacted with a heated block or plate, a method in which it is contacted with a hot plate, a hot presser, a hot roller, a hot drum, a halogen lamp heater or infrared or far infrared lamp heater and a method in which it is passed through a high temperature atmosphere.

With regard to the method for laminating the photosensitive material and the dye fixing element, the methods described in JP-A-62-253159 and JP-A-61-147244 (page 27) can be employed.

As occasion demands, any one of various developing apparatuses can be used in the treatment of the photographic elements of the present invention. Preferred examples of these apparatuses include those which are described for example in JP-A-59-75247, JP-A-59-177547, JP-A-59-181353, JP-A-60-18951, Japanese Utility Model Application Jikkai No. 62-25944, JP-A-6-130509, JP-A-6-95338, JP-A-6-95267, JP-A-8-29955 and JP-A-8-29954. As commercially available apparatuses, Pictrostat 100, Pictrostat 200, Pictrostat 300, Pictrostat 330, Pictrography 3000, Pictrography 4000 and the like (all manufactured by Fuji Photo Film) can be used.

EXAMPLES

The present invention will be described in greater detail with reference to the following Examples, but should not be construed as being limited thereto.

Example 1

First, method for the preparation of dye fixing element is described. A dye fixing element 100 was prepared by carrying out multilayer coating of the layer construction shown in Table 7 on the surface of the support shown in Table 6. Each of the compounds shown in Table 8 was added in respective amount shown in Table 8 to the fourth layer of the thus prepared dye fixing element, thereby obtaining dye fixing elements 101 to 122.

The dye fixing element 100 is an image forming material used as a comparative example which does not contain fading inhibitor. The dye fixing elements 101 to 105 are image forming materials used as comparative examples which contain compounds having low water-solubility disclosed in JP-A-4-125559, JP-A-62-144162 and JP-A-49-20974. Also, the dye fixing elements 106 to 122 are image forming materials of the present invention which contain the inventive compound having appropriate water-solubility.

TABLE 6

Construction of support

| Layer name | Composition | Thickness of film (μm) |
|---|---|---|
| Front side undercoat layer | Gelatin | 0.1 |
| Front side PE layer (glossy) | Low density polyethylene (density, 0.923): 90.2 parts<br>Surface-treated titanium oxide: 9.8 parts<br>Ultramarine: 0.001 part | 36.0 |
| Pulp layer | Wood-free paper (LBKP/NBSP = 6/4; density, 1.053) | 152.0 |
| Backside PE layer (mat) | High density polyethylene (density, 0.955) | 27.0 |
| Back side undercoat layer | Styrene/acrylate copolymer<br>Colloidal silica<br>Sodium polystyrenesulfonate | 0.1 |
| (Total) | | 215.2 |

TABLE 7

Construction of dye fixing element 100

| Layer No. | Additives | Amount coated ($mg/m^2$) |
|---|---|---|
| Sixth layer | Water-soluble polymer (1) | 130 |
| | Water-soluble polymer (2) | 35 |
| | Water-soluble polymer (3) | 45 |
| | Potassium nitrate | 20 |
| | Anionic surface active agent (1) | 6 |
| | Anionic surface active agent (2) | 6 |
| | Ampholytic surface active agent (1) | 50 |
| | Stain preventing agent (1) | 7 |
| | Stain preventing agent (2) | 12 |
| | Mat (1) | 7 |
| Fifth layer | Gelatin | 250 |
| | Water-soluble polymer (1) | 25 |
| | Anionic surface active agent (3) | 9 |
| | Hardening agent (1) | 185 |
| Fourth layer | Mordant (1) | 1850 |
| | Water-soluble polymer (2) | 260 |
| | Water-soluble polymer (4) | 1400 |
| | Latex dispersion (1) | 600 |
| | Anionic surface active agent (3) | 25 |
| | nonionic surface active agent (1) | 18 |
| | Guanidine picolinate | 1550 |
| | Sodium quinolinate | 350 |
| Third layer | Gelatin | 370 |
| | Mordant (1) | 300 |
| | Anionic surface active agent (3) | 12 |

TABLE 7-continued

Construction of dye fixing element 100

| Layer No. | Additives | Amount coated ($mg/m^2$) |
|---|---|---|
| Second layer | Gelatin | 700 |
| | Mordant (1) | 290 |
| | Water-soluble polymer (1) | 55 |
| | Water-soluble polymer (2) | 330 |
| | Anionic surface active agent (3) | 30 |
| | Anionic surface active agent (4) | 7 |
| | High boiling point organic solvent (1) | 700 |
| | Fluorescent brightener (1) | 30 |
| | Stain preventing agent (3) | 32 |
| | Guanidine picolinate | 360 |
| | Potassium quinolinate | 45 |
| First layer | Gelatin | 280 |
| | Water-soluble polymer (1) | 12 |
| | Anionic surface active agent (1) | 14 |
| | Sodium metaborate | 35 |
| | Hardening agent (1) | 185 |
| Support | The paper support of TABLE 3 (thickness 215 $\mu$m) | |

Coating amount of the latex dispersion is that of latex solid content.

TABLE 8

Added layers and added amounts of various fading inhibitors in dye fixing elements and their light fastness

| Image fixing element | Example | Fading inhibitor | Added layer | Added amount $mmol/m^2$ | Residual ratio of dye (%) Sensitive material 100 | Residual ratio of dye (%) Sensitive material 101 |
|---|---|---|---|---|---|---|
| 100 | Comparative | none | — | — | 50 | 65 |
| 101 | Comparative | B-1 | 4 | 5 | 53 | 65 |
| 102 | Comparative | B-2 | 4 | 2.5 | 55 | 62 |
| 103 | Comparative | B-3 | 4 | 5 | 58 | 66 |
| 104 | Comparative | B-4 | 4 | 5 | 55 | 63 |
| 105 | Comparative | B-5 | 4 | 5 | 60 | 73 |
| 106 | Inventive | a-2 | 4 | 5 | 70 | 88 |
| 107 | Inventive | a-4 | 4 | 5 | 68 | 90 |
| 108 | Inventive | a-5 | 4 | 5 | 75 | 92 |
| 109 | Inventive | a-10 | 4 | 5 | 72 | 91 |
| 110 | Inventive | a-15 | 4 | 5 | 69 | 87 |
| 111 | Inventive | a-18 | 4 | 5 | 70 | 88 |
| 112 | Inventive | a-26 | 4 | 5 | 73 | 86 |
| 113 | Inventive | a-34 | 4 | 5 | 75 | 90 |
| 114 | Inventive | a-35 | 4 | 5 | 74 | 91 |
| 115 | Inventive | a-39 | 4 | 5 | 75 | 92 |
| 116 | Inventive | a-51 | 4 | 2.5 | 72 | 85 |
| 117 | Inventive | a-53 | 4 | 2.5 | 74 | 88 |
| 118 | Inventive | a-68 | 4 | 2.5 | 70 | 86 |
| 119 | Inventive | a-72 | 4 | 2.5 | 68 | 89 |
| 120 | Inventive | a-53 | 4 | 5 | 75 | 92 |
| 121 | Inventive | a-53 | 4 | 10 | 72 | 93 |
| 122 | Inventive | a-53 | 6 | 2.5 | 68 | 89 |

B-1:

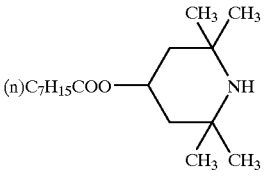

Illustrative example compound (1) described in JP-A-4-125559

B-2:

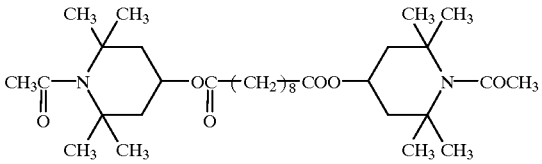

Illustrative example compound described in the above publication

B-3:

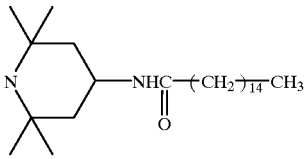

Compound 1 described in JP-A-62-144162

B-4:

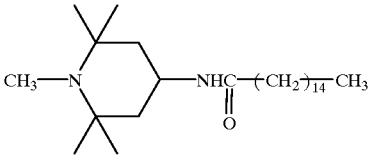

Compound 2 in JP-A-62-144162

B-5:

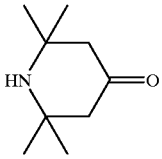

Compound 1 in JP-B-49-20974

Anionic surface active agent (1):

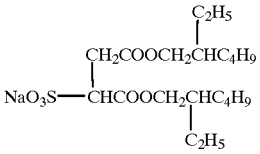

Anionic surface active agent (2):

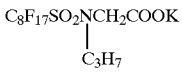

Anionic surface active agent (3):

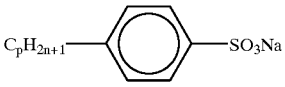

$n \approx 12.6$

-continued

Anionic surface active agent (4):

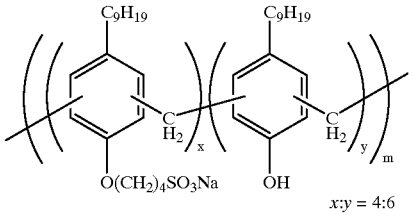

$x:y = 4:6$
$m \approx 6.8$

Nonionic surface active agent (1):

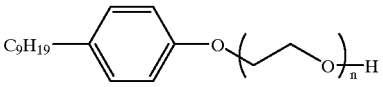

$n = 85$

Ampholytic surface active agent (1):

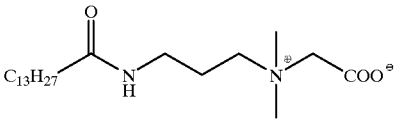

Flourescent brightener (1):

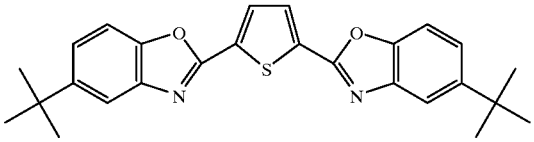

Mordant (1):

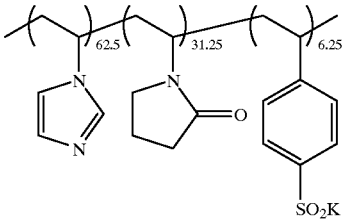

Stain preventing agents:

(1)

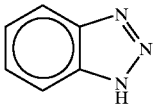

(2)

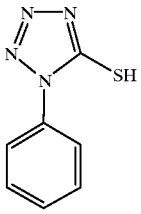

(3)

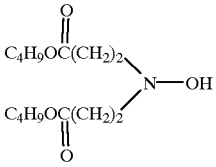

High boiling point organic solvent (1):
$C_{28}H_{48.9}Cl_{7.1}$ Empara 40 (mfd. by Ajinomoto)
Water-soluble polymer (1):

Sumica Gel L5-H (mfd. by Sumitomo Chemical)
Water-soluble polymer (2):

Dextran (molecular weight, 70,000)
Water-soluble polymer (3):

Kappa carrageenan (mfd. by Taito)
Water-soluble polymer (4):

MP polymer MP-102 (mfd. by Kuraray)
Latex dispersion (1):

LX-438 (mfd. by Nippon Zeon)
Matting agent (1):

SYLOID 79 (mfd. by Fuji Davisson Chemical)

Hardening agent (1):

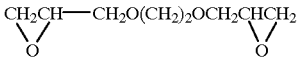

Next, method for the preparation of heat developing color photosensitive material is described.

Firstly, method for the preparation of photosensitive silver halide emulsion is described. Photosensitive silver halide (1) [Emulsion for use in the fifth layer (680 nm photosensitive layer)]

Solutions (I) and (II) having respective compositions shown in Table 10 were simultaneously added spending 13 minutes to a thoroughly stirring aqueous solution having the composition shown in Table 9 and then, 10 minutes thereafter, solutions (III) and (IV) having respective compositions shown in Table 10 were added thereto spending 33 minutes.

TABLE 9

| Composition | |
|---|---|
| $H_2O$ | 620 cc |
| Lime-treated gelatin | 20 g |
| KBr | 0.3 g |
| NaCl | 2 g |
| Silver halide solvent (1) | 0.030 g |
| Sulfuric acid (1 N) | 16 cc |
| Temperature | 45° C. |

Silver halide solvent (1):

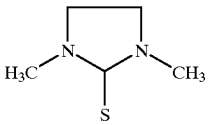

TABLE 10

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_2IrCl_6$ | — | — | — | 0.039 mg |
| Total volume | 126 ml by adding water | 132 ml by adding water | 254 ml by adding water | 252 ml by adding water |

Also, 13 minutes after commencement of the addition of the solution (III), 150 cc of an aqueous solution containing 0.350% of a sensitizing dye (1) was added spending 27 minutes.

Sensitizing dye (1):

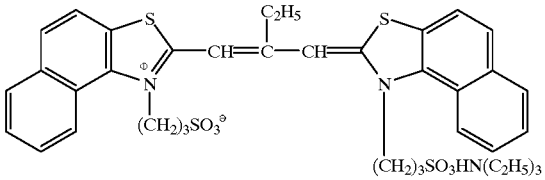

After carrying out water washing and desalting (carried out at pH 4.1 using a precipitation agent a) in the usual way, 22 g of lime-treated ossein gelatin was added, the resulting mixture was adjusted to pH 6.0 and pAg 7.9 and then chemical sensitization was carried out at 60° C. The compounds used in chemical sensitization are as shown in Table 11. The thus obtained emulsion with a yield of 630 g was a mono-dispersed cubic silver chlorobromide emulsion with a coefficient of variation of 10.2%, and its average particle size was 0.20 $\mu$m.

Precipitation agent a:

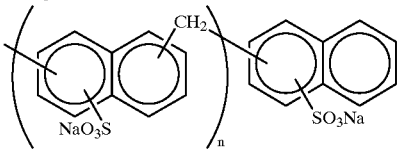

Precipitation agent b:

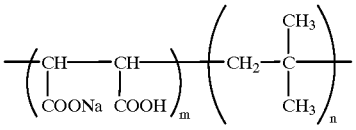

TABLE 11

| Compounds used in chemical sensitization | Amount added |
|---|---|
| 4-Hydroxy-6-methyl-1,3,3a,7-tetrazaindene | 0.36 g |
| Sodium thiosulfate | 6.75 mg |
| Anti-fogging agent (1) | 0.11 g |
| Antiseptic agent (1) | 0.07 g |
| Antiseptic agent (2) | 3.13 g |

Anti-fogging agent (1):

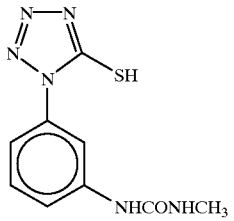

Antiseptic agent (1):

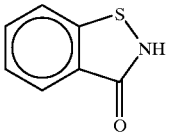

Antiseptic agent (2):

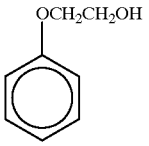

Photosensitive silver halide emulsion (2) (Emulsion for use in the third layer (750 nm photosensitive layer)):

Solutions (I) and (II) having respective compositions shown in Table 13 were simultaneously added spending 18 minutes to a thoroughly stirring aqueous solution having the composition shown in Table 12 and then, 10 minutes thereafter, solutions (III) and (IV) having respective compositions shown in Table 13 were added thereto spending 24 minutes.

TABLE 12

| Composition | |
|---|---|
| $H_2O$ | 620 cc |
| Lime-treated gelatin | 20 g |
| KBr | 0.3 g |
| NaCl | 2 g |
| Silver halide solvent (1) | 0.030 g |
| Sulfuric acid (1 N) | 16 cc |
| Temperature | 45° C. |

TABLE 13

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.2 g |
| NaCl | — | 3.62 g | — | 2.4 g |
| $K_4[Fe(CN)_6]\cdot H_2O$ | — | — | — | 0.07 g |
| $K_2IrCl_6$ | — | — | — | 0.040 mg |
| Total volume | 188 ml by adding water | 188 ml by adding water | 250 ml by adding water | 250 ml by adding water |

After carrying out water washing and desalting (carried out at pH 3.9 using a precipitation agent b) in the usual way, 22 g of lime-treated ossein gelatin which has been subjected to calcium-removing treatment (calcium content, 150 ppm or less) was added and re-dispersed at 40° C., 0.39 g of 4-hydroxy-6-methyl-1,3,3a,7-tetrazaindene was added thereto and then the resulting mixture was adjusted to a pH value of 5.9 and a pAg value of 7.8. Thereafter, chemical sensitization was carried out at 70° C. The compounds used in chemical sensitization are as shown in Table 14. At the final stage of the chemical sensitization, a sensitizing dye (2) was added as a methanol solution (a solution having the composition shown in Table 15). After completion of the chemical sensitization, the reaction temperature was reduced to 40° C., 200 g of a gelatin dispersion of a stabilizing agent (1) which will be described later was added thereto, and the mixture was thoroughly stirred and then stored. The thus obtained emulsion with a yield of 938 g was a monodispersed cubic silver chlorobromide emulsion with a coefficient of variation of 12.6%, and its average particle size was 0.25 μm.

TABLE 14

| Compounds used in chemical sensitization | Amount added |
|---|---|
| 4-Hydroxy-6-methyl-1,3,3a,7-tetrazaindene | 0.39 g |
| Triethylthiourea | 3.3 mg |
| Nucleic acid hydrolysate | 0.39 g |
| NaCl | 0.15 g |
| KI | 0.12 g |
| Anti-fogging agent (2) | 0.10 g |
| Antiseptic agent (1) | 0.07 g |

TABLE 15

| Composition of dye solution | Amount added |
|---|---|
| Sensitizing dye (2) | 0.19 g |
| Methanol | 18.7 cc |

Stabilizing agent (1):

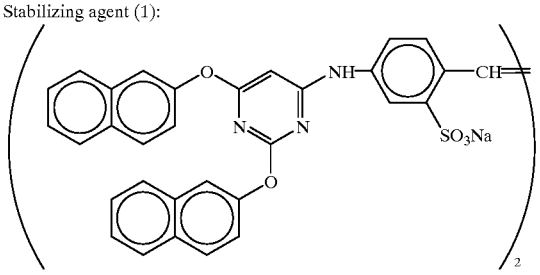

-continued

Anti-fogging agent (2):

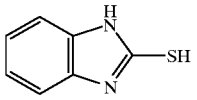

-continued

Sensitizing dye (2):

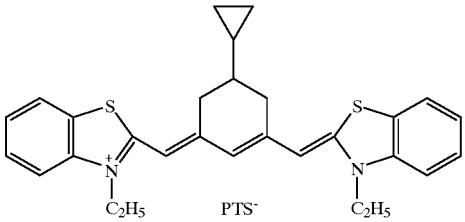

PTS: paratoluene sulfonate

Photosensitive silver halide emulsion (3) (Emulsion for use in the first layer (810 nm photosensitive layer)):

Solutions (I) and (II) having respective compositions shown in Table 17 were simultaneously added spending 18 minutes to a thoroughly stirring aqueous solution having the composition shown in Table 16 and then, 10 minutes thereafter, solutions (III) and (IV) having respective compositions shown in Table 17 were added thereto spending 24 minutes.

TABLE 16

| Composition | |
|---|---|
| $H_2O$ | 620 cc |
| Lime-treated gelatin | 20 g |
| KBr | 0.3 g |
| NaCl | 2 g |
| Silver halide solvent (1) | 0.030 g |
| Sulfuric acid (1 N) | 16 cc |
| Temperature | 45° C. |

TABLE 17

| | Solution (I) | Solution (II) | Solution (III) | Solution (IV) |
|---|---|---|---|---|
| $AgNO_3$ | 30.0 g | — | 70.0 g | — |
| KBr | — | 13.7 g | — | 44.1 g |
| NaCl | — | 3.62 g | — | 2.4 g |
| $K_2IrCl_6$ | — | — | — | 0.020 mg |
| Total volume | 180 ml by adding water | 181 ml by adding water | 242 ml by adding water | 250 ml by adding water |

After carrying out water washing and desalting (carried out at pH 3.8 using the precipitation agent a) in the usual way, 22 g of lime-treated ossein gelatin was added, and the resulting mixture was adjusted to a pH value of 7.4 and a pAg value of 7.8. Thereafter, chemical sensitization was carried out at 60° C. The compounds used in chemical sensitization are as shown in Table 18. The thus obtained emulsion with a yield of 683 g was a mono-dispersed cubic silver chlorobromide emulsion with a coefficient of variation of 9.7%, and its average particle size was 0.32 μm.

TABLE 18

| Compounds used in chemical sensitization | Amount added |
|---|---|
| 4-Hydroxy-6-methyl-1,3,3a,7-tetrazaindene | 0.38 g |
| Triethylthiourea | 3.10 mg |
| Anti-fogging agent (2) | 0.19 g |
| Antiseptic agent (1) | 0.07 g |
| Antiseptic agent (2) | 3.13 g |

Next, method for the preparation of silver chloride fine particles to be added to the first layer (810 nm photosensitive layer) is described.

Solutions (I) and (II) having respective compositions shown in Table 20 were simultaneously added spending 4 minutes to a thoroughly stirring aqueous solution having the composition shown in Table 19 and then, 3 minutes thereafter, solutions (III) and (IV) having respective compositions shown in Table 20 were added thereto spending 8 minutes.

TABLE 19

| Composition | |
|---|---|
| $H_2O$ | 3770 cc |
| Lime-treated gelatin | 60 g |
| NaCl | 0.8 g |
| 38° C. | |

TABLE 20

| | Solution (I) | Solution (II) | Solution (III) | Solution (IV) |
|---|---|---|---|---|
| $AgNO_3$ | 300 g | | 300 g | |
| $NH_4NO_3$ | 10 g | | 10 g | g |
| NaCl | | 108 g | | 104 g |
| Total volume | 940 ml by adding water | 940 ml by adding water | 1170 ml by adding water | 1080 ml by adding water |

After carrying out water washing and desalting (carried out at pH 3.9 using the precipitation agent a) in the usual way, 132 g of lime-treated gelatin was added, re-suspended at 35° C., 4 g of 4-hydroxy-6-methyl-1,3,3a,7-tetrazaindene was added thereto and then the resulting mixture was adjusted to a pH value of 5.7. Yield of the thus obtained solver chloride fine particle emulsion was 3, 200 g, and its average particle size was 0.10 μm.

Next, method for the preparation of a gelatin dispersion of colloidal silver is described.

A solution having the composition shown in Table 22 was added spending 4 minutes to a thoroughly stirring aqueous solution having the composition shown in Table 21. Thereafter, this was washed with water using the precipitation agent a, mixed with 43 g of lime-treated ossein gelatin and then adjusted to pH 6.3. The average particle size was 0.02 μm and the yield was 512 g (a dispersion containing 2% silver and 6.8% gelatin).

TABLE 21

| Composition | |
|---|---|
| $H_2O$ | 620 cc |
| Dextrin | 16 g |
| NaOH (5 N) | 41 cc |
| Temperature | 30° C. |

TABLE 22

| Composition | |
|---|---|
| $H_2O$ | 135 cc |
| $AgNO_3$ | 17 g |

Next, method for the preparation of a gelatin dispersion of hydrophobic additives is described.

Gelatin dispersions of a yellow dye donating compound, a magenta dye donating compound and a cyan dye donating compound were prepared in accordance with the formulations shown in Table 23. That is, respective oil phase components were made into a uniform solution by dissolving them under heating at about 70° C., corresponding solution of water phase components heated at about 60° C. was added to the former solution and mixed with stirring, and the mixture was then dispersed using a homogenizer at 10,000 rpm for 10 minutes. This was mixed with water and stirred to obtain a uniform dispersion. Also, a gelatin dispersion of a cyan dye donating compound was subjected to dilution with water and concentration repeatedly using an ultrafiltration module (ACV-3050 mfd. by Asahi Chemical Industry), thereby reducing its ethyl acetate content to 1/17.6 of the amount of ethyl acetate shown in Table 23.

TABLE 23

| | | Dispersion composition | | | | | |
|---|---|---|---|---|---|---|---|
| | | Yellow (1) | Yellow (2) | Magenta (1) | Magenta (2) | Cyan (1) | Cyan (2) |
| Oil phase | | | | | | | |
| Cyan dye donor compd. (2) | (g) | — | — | — | — | 10.3 | — |
| Cyan dye donor compd. (1) | (g) | — | — | — | — | 7.2 | — |
| Cyan dye donor compd. (3) | (g) | — | — | — | — | — | 15.3 |
| Magenta dye donor compd. (1) or (2) | (g) | — | — | 16.3 | 16.3 | — | — |
| Yellow dye donor compd. (1) or (2) | (g) | 9.8 | 9.8 | — | — | — | — |
| Reducing agent (1) | (g) | 0.9 | 0.9 | 0.2 | 0.2 | 1.0 | 1.0 |
| Anti-fogging agent (3) | (g) | 0.1 | 0.1 | — | — | 0.2 | 0.2 |
| Anti-fogging agent (4) | (g) | — | — | 0.7 | 0.7 | — | — |
| Surface active agent (1) | (g) | 1.1 | 1.1 | — | — | — | — |
| High boiling point solvent (1) | (g) | — | — | — | — | 4.6 | 4.6 |
| High boiling point solvent (2) | (g) | 4.9 | 4.9 | 7.4 | 7.4 | 4.9 | 15.3 |
| High boiling point solvent (3) | (g) | — | — | — | — | 1.2 | — |
| Development accelerator (1) | (g) | 2.5 | 2.5 | 2.9 | 2.9 | — | — |
| Dye (a) | (g) | 1.1 | 1.1 | — | — | 0.5 | 0.5 |
| Water | (ml) | 0.4 | 0.4 | — | — | — | 1.0 |
| Ethyl acetate | (ml) | 9.6 | 9.6 | 50.1 | 50.1 | 55.2 | 55.2 |
| Water phase | | | | | | | |
| Lime-treated gelatin | (g) | 10.0 | 10.0 | 10.0 | 10.0 | 10.0 | 10.0 |
| Calcium nitrate | (g) | 0.1 | 0.1 | 0.1 | 0.1 | — | — |
| Surface active agent | (g) | — | — | 0.2 | 0.2 | 0.8 | 0.8 |
| NaOH aqueous solution (1 N) | (ml) | — | — | 1.9 | 1.9 | — | — |
| Carboxymethyl cellulose | (g) | — | — | — | — | 0.3 | 0.3 |
| Water | (ml) | 26.1 | 26.1 | 139.7 | 139.7 | 95.9 | 95.9 |
| Addition of water | (ml) | 99.9 | 99.9 | 157.3 | 157.3 | 209.0 | 201.0 |
| Antiseptic agent (1) | (g) | 0.004 | 0.004 | 0.04 | 0.04 | 0.1 | 0.1 |

A gelatin dispersion of the anti-fogging agent (4) was prepared in accordance with the formulation shown in Table 24. That is, the oil phase components were dissolved under heating at about 60° C., the solution of water phase components heated at about 60° C. was added to the former solution and mixed with stirring, and the mixture was then dispersed using a homogenizer at 10,000 rpm for 10 minutes to obtain a uniform dispersion.

TABLE 24

| | | Dispersion composition |
|---|---|---|
| Oil phase | Anti-fogging agent (4) | 0.8 g |
| | Reducing agent (1) | 0.1 g |
| | High boiling point solvent (2) | 2.3 g |
| | High boiling point solvent (5) | 0.2 g |
| | Surface active agent (1) | 0.5 g |
| | Surface active agent (4) | 0.5 g |
| | Ethyl acetate | 10.0 ml |
| Water phase | Acid-treated gelatin | 10.0 g |
| | Antiseptic agent (1) | 0.004 g |
| | Calcium nitrate | 0.1 g |
| | Water | 35.0 ml |
| | Addition of water | 46.0 ml |

A gelatin dispersion of the high boiling point solvent (2) was prepared in accordance with the formulation shown in Table 25. That is, the oil phase components were dissolved under heating at about 60° C., the solution of water phase components heated at about 60° C. was added to the former solution and mixed with stirring, and the mixture was then dispersed using a homogenizer at 10,000 rpm for 10 minutes to obtain a uniform dispersion.

TABLE 25

| | | Dispersion composition |
|---|---|---|
| Oil phase | High boiling point solvent (2) | 9.1 g |
| | High boiling point solvent (5) | 0.2 g |
| | Surface active agent (1) | 0.5 g |
| | Surface active agent (4) | 0.5 g |
| | Ethyl acetate | 10.0 ml |
| Water phase | Acid-treated gelatin | 10.0 g |
| | Antiseptic agent (1) | 0.004 g |
| | Calcium nitrate | 0.1 g |
| | Water | 74.0 ml |
| | Addition of water | 104.0 ml |

A gelatin dispersion of the reducing agent (2) was prepared in accordance with the formulation shown in Table 26. That is, the oil phase components were dissolved under heating at about 60° C., the solution of water phase components heated at about 60° C. was added to the former solution and mixed with stirring, and the mixture was then dispersed using a homogenizer at 10,000 rpm for 10 minutes to obtain a uniform dispersion. Thereafter, ethyl acetate was removed from the thus obtained dispersion using a vacuum organic solvent removing apparatus.

TABLE 26

| | | Dispersion composition |
|---|---|---|
| Oil phase | Reducing agent (2) | 7.5 g |
| | High boiling point solvent (1) | 4.7 g |
| | Surface active agent (1) | 1.9 g |
| | Ethyl acetate | 14.4 ml |
| Water phase | Acid-treated gelatin | 10.0 g |
| | Antiseptic agent (1) | 0.02 g |
| | Antiseptic agent (4) | 0.04 g |
| | Sodium hydrogen sulfite | 0.1 g |
| | Water | 136.7 ml |

A gelatin dispersion of a polymer latex (a) was prepared in accordance with the formulation shown in Table 27. That is, an anionic surface active agent (6) was added, spending 10 minutes, to a stirred mixed solution consisting of the polymer latex (a), a surface active agent (5) and water in respective amounts shown in Table 27, thereby obtaining a uniform dispersion. The thus obtained dispersion was repeatedly subjected to dilution with water and concentration using an ultrafiltration module (ACV-3050 mfd. by Asahi Chemical Industry), thereby reducing salt concentration in the dispersion to 1/9.

TABLE 27

| | |
|---|---|
| Polymer latex (a) aqueous solution (solid content, 13%) | 108.0 ml |
| Surface active agent (5) | 20.0 g |
| Anionic surface active agent (6) aqueous solution (5%) | 600.0 ml |
| Water | 1,232.0 ml |

A gelatin dispersion of a stabilizing agent (1) was prepared in accordance with the formulation shown in Table 28. That is, the oil phase components were dissolved at room temperature, the solution of water phase components heated at about 40° C. was added to the former solution and mixed with stirring, and the mixture was then dispersed using a homogenizer at 10,000 rpm for 10 minutes. This was mixed with water and stirred to obtain a uniform dispersion.

TABLE 28

| | | Dispersion composition |
|---|---|---|
| Oil phase | Stabilizing agent (1) | 4.0 g |
| | Sodium hydroxide | 0.3 g |
| | Methanol | 62.8 g |
| | High boiling point solvent (2) | 0.9 g |
| Water phase | Calcium-removed gelatin (Ca content, 100 ppm or less) | 10.0 g |
| | Antiseptic agent (1) | 0.04 g |
| | Water | 320.5 ml |

A gelatin dispersion of zinc hydroxide was prepared in accordance with the formulation shown in Table 29. That is, the components were mixed and dissolved and then dispersed for 30 minutes in a mill using glass beads of 0.75 mm in average particle size. Thereafter, these glass beads were separated and removed to obtain a uniform dispersion. (In this case, zinc oxide having an average particle size of 0.25 μm was used.)

TABLE 29

| | Dispersion composition |
|---|---|
| Zinc hydroxide | 15.9 g |
| Carboxymethyl cellulose | 0.7 g |
| Sodium polyacrylate | 0.07 g |
| Line-treated gelatin | 4.2 g |
| Water | 100 ml |
| High boiling point solvent (2) | 0.4 g |

Next, method for the preparation of a gelatin dispersion of a mat to be added to the protecting layer is described.

A solution prepared by dissolving PMMA in methylene chloride was added to gelatin together with a small amount of a surface active agent and then dispersed by high speed stirring. Subsequently, methylene chloride was removed using a vacuum solvent-removing apparatus to obtain a uniform dispersion having an average particle size of 4.3 μm.

Cyan dye donating compound (1):
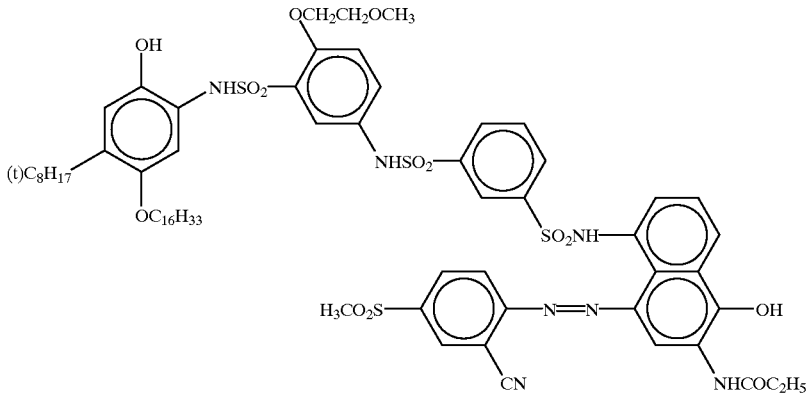
Cyan dye donating compound (2):
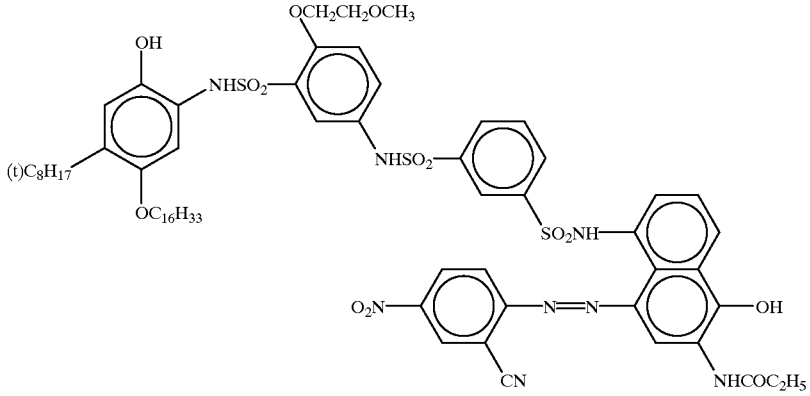
Cyan dye donating compound (3):
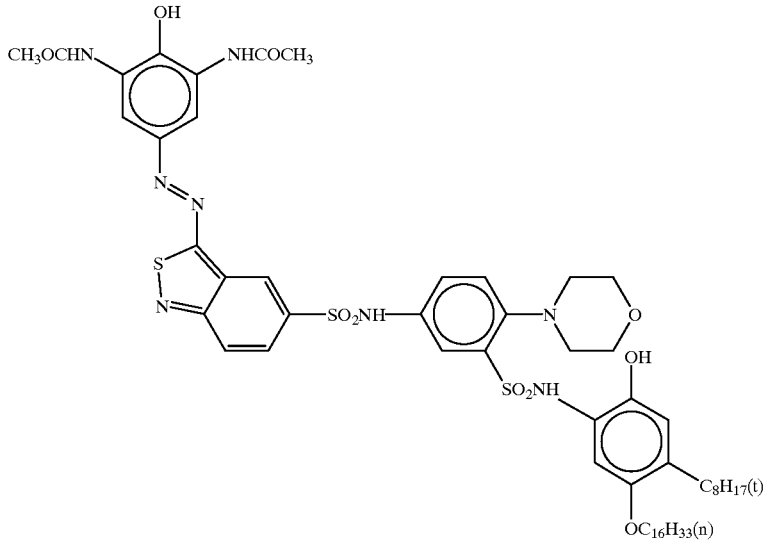

-continued
Dye (a):
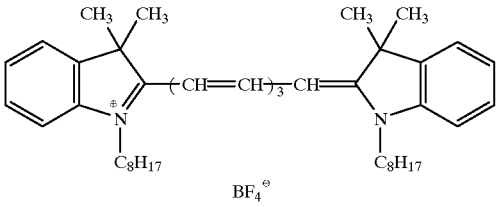
Magenta dye donating compound (1):
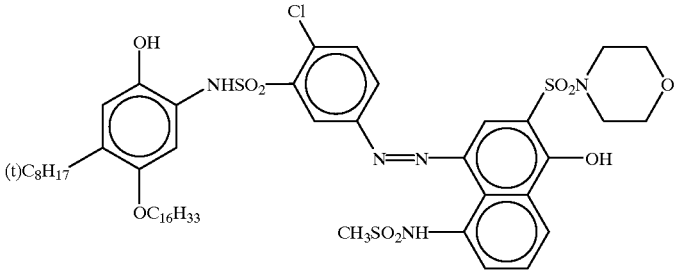
Magenta dye donating compound (2):
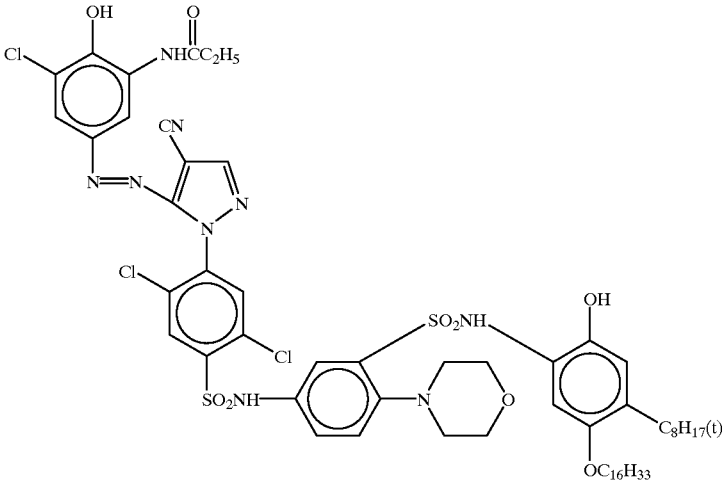
Yellow dye donating compound (1):
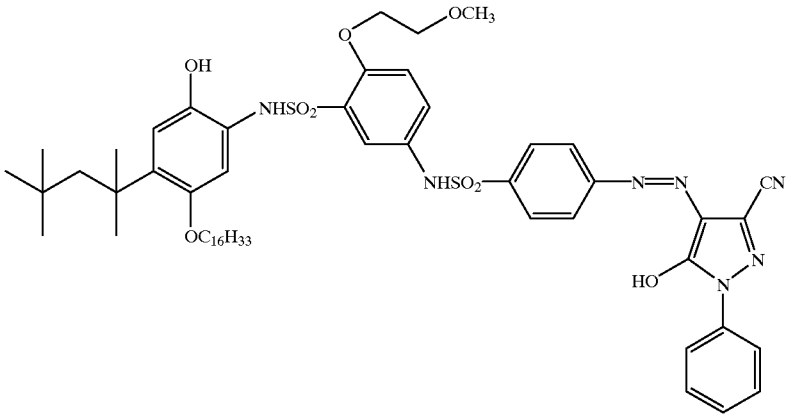

-continued
Yellow dye donating compound (2):
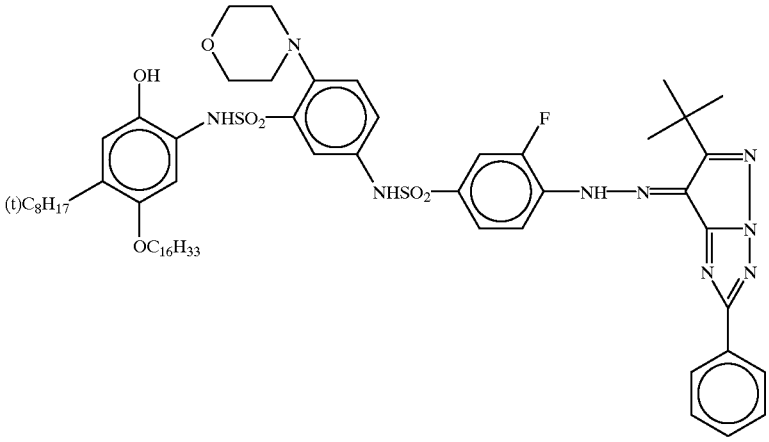
Reducing agent (1):
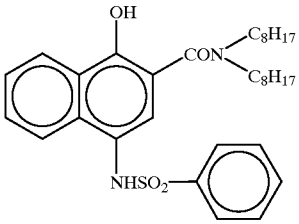
Anti-fogging agent (3):
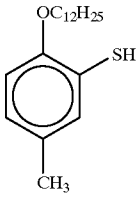
Anti-fogging agent (4):
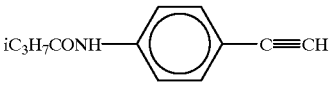
Surface active agent (1):
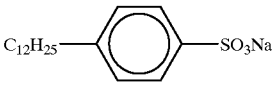
Development accelerator (1):
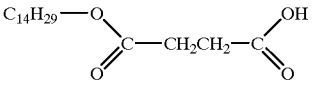
High boiling point solvent (1):
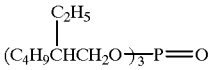
High boiling point solvent (2):
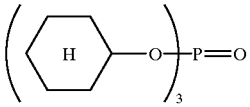
High boiling point solvent (3):
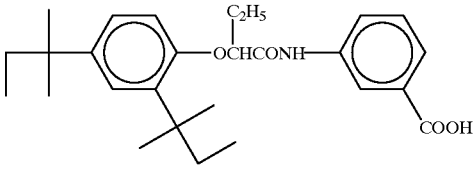
Antiseptic agent (3):
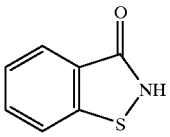
Reducing agent (2):
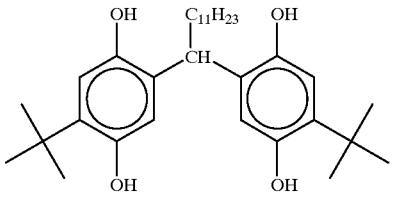

-continued

Antiseptic agent (4):

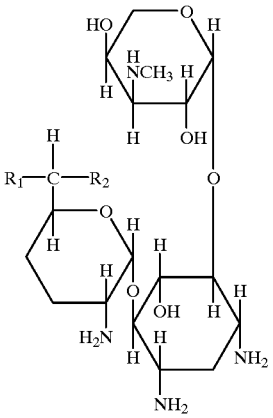

| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |

Surface active agent (2):

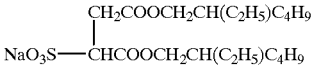

Surface active agent (3):

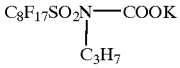

Water-soluble polymer (1):

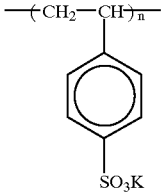

Limiting viscosity number [η] = 1.6 (0.1 N NaCl, 30° C.)

Molecular weight = 1,000,000

Water-soluble polymer (2):

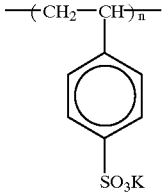

Limiting viscosity number [η] = 0.8 (0.1 N NaCl, 30° C.)

Molecular weight = 400,000

Anti-fogging agent (5):

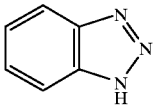

Sensitizing dye (3):

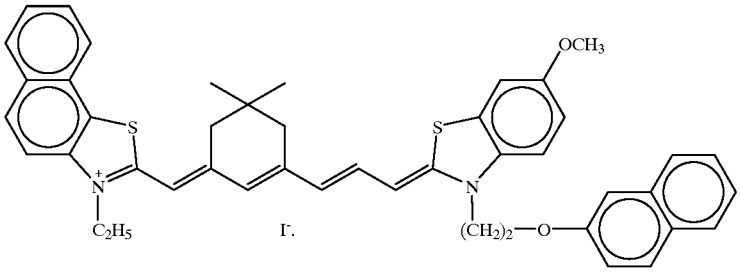

Hardening agent (1):

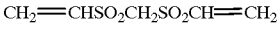

Surface active agent (4):

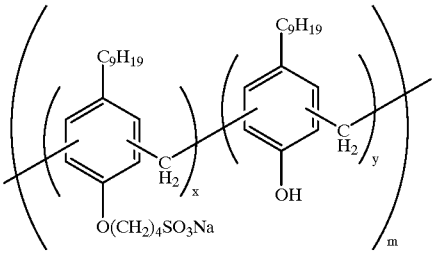

x:y = 4:6 m ≈ 6.8

High boiling point organic solvent (5):

$C_{26}H_{46.9}Cl_{7.1}$ Empara 40 (mfd. by Ajinomoto)

-continued

Polymer latex a:

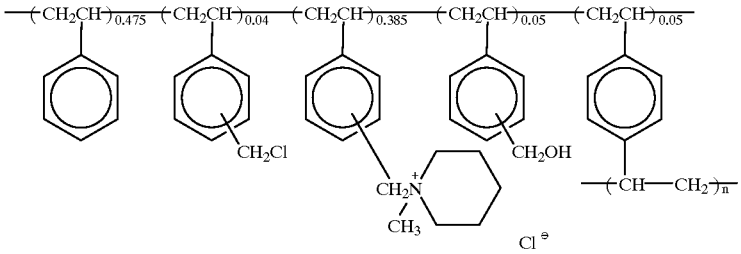

Surface active agent (5):

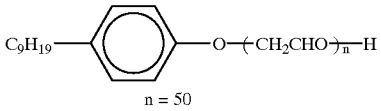

n = 50

Anionic surface active agent (6):

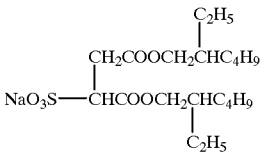

Using the above additive agents, the heat developing color photosensitive materials 100 and 101 shown in Tables 30 and 31 were prepared.

TABLE 30

Construction of main raw materials of heat developing photosensitive materials 100 and 101

| Layer No. | Layer name | Additive agents | 100 Amount coated (mg/m2) | 101 Amount coated (mg/m2) |
|---|---|---|---|---|
| Seventh layer | Protective layer | Acid-treated gelatin | 437 | 437 |
| | | Reducing agent (2) | 51 | 51 |
| | | High boiling point solvent (1) | 32 | 32 |
| | | Colloidal silver particles | 2 | 2 |
| | | Mat (PMMA resin) | 17 | 17 |
| | | Surface active agent (2) | 16 | 16 |
| | | Surface active agent (1) | 13 | 13 |
| | | Surface active agent (3) | 2 | 2 |
| | | Polymer latex a | 11 | 11 |
| Sixth layer | Intermediate layer | Lime-treated gelatin | 862 | 862 |
| | | Zinc hydroxide | 480 | 480 |
| | | Anti-fogging agent (4) | 14 | 14 |
| | | Reducing agent (1) | 2 | 2 |
| | | High boiling point solvent (2) | 42 | 42 |
| | | High boiling point solvent (5) | 4 | 4 |
| | | Surface active agent (1) | 9 | 9 |
| | | Surface active agent (4) | 9 | 9 |
| | | Water-soluble polymer (1) | 4 | 4 |
| | | Calcium nitrate | 21 | 21 |
| Fifth layer | 680 nm Photo-sensitive layer | Lime-treated gelatin | 452 | 452 |
| | | Photosensitive silver halide emulsion (1) | 301 as Ag | 301 as Ag |
| | | Magenta dye donating compound (1) | 389 | — |
| | | Magenta dye donating compound (2) | — | 455 |
| | | High boiling point solvent (2) | 291 | 291 |
| | | Reducing agent (1) | 6 | 6 |
| | | Development accelerator (1) | 60 | 60 |
| | | Anti-fogging agent (4) | 20 | 20 |
| | | Surface active agent (1) | 0.3 | 0.3 |
| | | Water-soluble polymer (1) | 11 | 11 |
| Fourth layer | Intermediate layer | Lime-treated gelatin | 485 | 485 |
| | | Anti-fogging agent (4) | 8 | 8 |
| | | Reducing agent (1) | 1 | 1 |
| | | High boiling point solvent (2) | 24 | 24 |
| | | High boiling point solvent (5) | 2 | 2 |

TABLE 30-continued

Construction of main raw materials of heat developing photosensitive materials 100 and 101

| Layer No. | Layer name | Additive agents | 100 Amount coated (mg/m2) | 101 Amount coated (mg/m2) |
|---|---|---|---|---|
| | | Surface active agent (1) | 5 | 5 |
| | | Surface active agent (4) | 5 | 5 |
| | | Water-soluble polymer (1) | 2 | 2 |
| | | Calcium nitrate | 8 | 8 |

TABLE 31

(continued from TABLE 30)

| Layer No. | Layer name | Additive agents | 100 Amount coated (mg/m2) | 101 Amount coated (mg/m2) |
|---|---|---|---|---|
| Third layer | 750 nm Photo-sensitive layer | Lime-treated gelatin | 373 | 373 |
| | | Photosensitive silver halide emulsion (2) | 106 as Ag | 106 as Ag |
| | | Stabilizing agent (1) | 9 | 9 |
| | | Cyan dye donating compound (1) | 155 | — |
| | | Cyan dye donating compound (2) | 222 | — |
| | | Cyan dye donating compound (3) | — | 326 |
| | | Dye (a) | 10 | 10 |
| | | High boiling point solvent (1) | 101 | 101 |
| | | High boiling point solvent (2) | 108 | 108 |
| | | High boiling point solvent (3) | 27 | 27 |
| | | Reducing agent (1) | 22 | 22 |
| | | Anti-fogging agent (3) | 4 | 4 |
| | | Surface active agent (1) | 0.9 | 0.9 |
| | | Carboxymethyl cellulose | 5 | 5 |
| | | Water-soluble polymer | 11 | 1′ |
| Second layer | Intermediate layer | Lime-treated gelatin | 438 | 438 |
| | | Anti-fogging agent (5) | 5 | 5 |
| | | Surface active agent (5) | 150 | 150 |
| | | Water-soluble polymer (2) | 26 | 26 |
| | | Calcium nitrate | 8 | 8 |
| First layer | 810 nm Photo-sensitive layer | Lime-treated gelatin | 587 | 587 |
| | | Photosensitive silver halide emulsion (3) | 311 as Ag | 311 as Ag |
| | | Silver chloride fine particles | 62 as Ag | 62 as Ag |
| | | Stabilizing agent (1) | 8 | 8 |
| | | Yellow dye donating compound (1) | 403 | — |
| | | Yellow dye donating compound (3) | — | 322 |
| | | Sensitizing dye (3) | 0.1 | 0.1 |
| | | Dye (a) | 44 | 44 |
| | | High boiling point solvent (2) | 201 | 201 |
| | | Reducing agent (1) | 35 | 35 |
| | | Development accelerator (1) | 101 | 101 |
| | | Anti-fogging agent (3) | 6 | 6 |
| | | Water-soluble polymer (2) | 46 | 46 |
| | | Hardening agent (1) | 45 | 45 |
| Support (paper support laminated with polyethylene: 131 μm in thickness) | | | | |

(Note) Minor additive agents such as antiseptic agent and the like are omitted.

The photosensitive materials 100 and 101 are different from each other only in terms of the dye donating compounds used therein. That is, in the photosensitive material 101, the magenta dye donating compound dispersion was changed from (1) of the photosensitive material 100 to (2), the cyan dye donating compound dispersion from (1) and (2) to (3), and the yellow dye donating compound dispersion from (1) to (3).

The aforementioned dye fixing elements 100 to 122 were combined with the just described photosensitive material 100 or 101, and black solid images were obtained by carrying out exposure and development using a printer manufactured by Fuji Photo Film under a trade name of Pictrography 3000.

When the amount of the fading inhibitor in each of the black solid images was quantitatively measured, it was found that about 100% of the fading inhibitor was contained in black solid images of the dye fixing elements 101 to 105, and approximately 50 to 90% of the fading inhibitor was contained in black solid images of the dye fixing elements 106 to 122.

Light fading test of these black solid images was carried out using Weather-Ometer 65WRC manufactured by ATLAS at a cycle of light (100,000 Lux)/shade=3.8 hr/1 hr without attaching filters and the like. Residual ratio of dye after the fading test was calculated by measuring reflection density of cyan in each of the black solid images before the test and one week after the test using X-rite 310TR manufactured by X-rite. The results are shown in Table 8. It is evident from Table 8 that light fastness is markedly improved in the image forming material (dye fixing element) which contains the fading inhibitor of the present invention having appropriate water-solubility, in comparison with the image forming material containing no fading inhibitor or the image forming material which contains a water-insoluble fading inhibitor.

Black solid images were prepared in the same manner, except that the photosensitive material to be used was changed to Pictrostat Donor Film PS-DS manufactured by Fuji Photo Film and the printer was changes from Pictrography 3000 to a printer manufactured by Fuji Photo Film under a trade name of Pictrostat 330, and the same test was carried out to find similar effects.

Also, when the fading inhibitor of the present invention was added to the photosensitive material, it was confirmed that light fastness of images transferred to the dye fixing element is improved.

Example 2

A photosensitive material 201 was prepared by changing the yellow dye donating compound (1) in the first layer of the photosensitive material 100 used in Example 1 to coupler (1) and agent (1), the cyan dye donating compound (1) in the third layer to coupler (2) and agent (2) and the magenta dye donating compound (1) in the fifth layer to the coupler (1) and the agent (2). When the thus prepared photosensitive material 201 was tested in the same manner as described in Example 1, it was confirmed that it has a fading-inhibiting effect similar to that of Example 1.

Coupler (1):

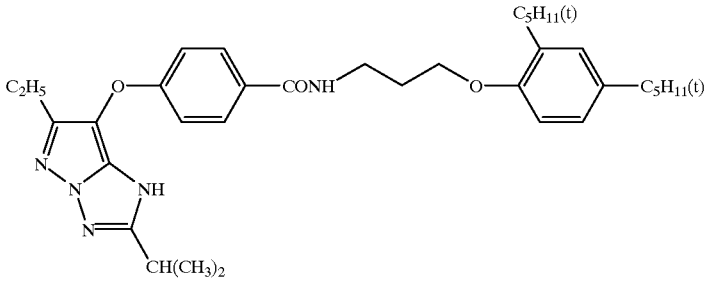

Coupler (2):

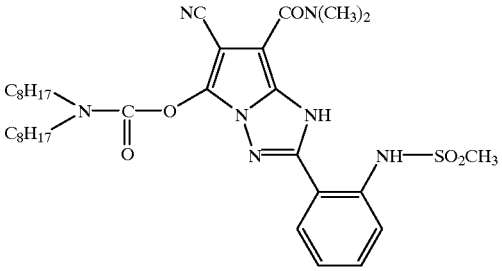

Agent (1):

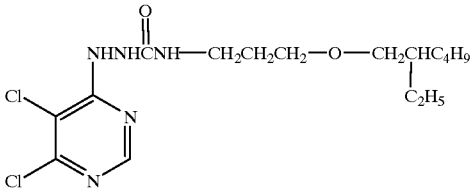

Agent (2):

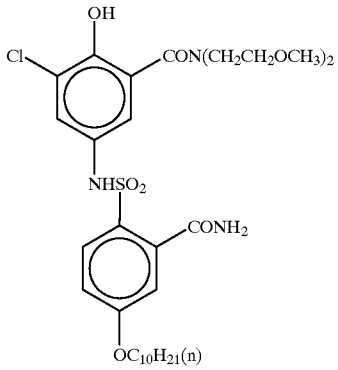

Example 3

A photosensitive material prepared by combining a photosensitive element (101) (to be referred to as photosensitive element (400) hereinafter), image receiving elements (201) and (212) (to be referred to as image receiving elements (400) and (500) hereinafter) and an alkali processing composition (301) (to be referred to as alkali processing composition (400) hereinafter), all described in Examples of Japanese Patent Application No. 8-316885, was used as a comparative example photosensitive material containing no fading inhibitor, and the fading inhibitor of the present invention was added thereto to evaluate its light fastness.

That is, image receiving elements (401) to (420) and image receiving elements (501) to (515) were prepared by adding the fading inhibitors shown in Table 32, in corresponding amounts also shown in Table 32, to a mordant layer (5) of the image receiving elements (400) and (500).

Next, the unexposed photosensitive element (400) and each of the image receiving elements (400) to (420) and image receiving elements (500) to (515) were put together, with their application surfaces facing each other, and the alkali processing composition (400) was developed between both elements to a thickness of 60 $\mu$m.

The developing treatment was carried out at 25° C., and the photosensitive element and image receiving element were separated from each other 90 seconds after the developing treatment to obtain a black solid image.

Light fading test of the thus obtained black solid images was carried out using Weather-Ometer 65WRC Xenon Fading Tester manufactured by ATLAS at a cycle of light (100,000 Lux)/shade=3.8 hr/1 hr without attaching filters and the like. Residual ratio of dye after the fading test was calculated by measuring reflection density of each of the black solid images before the test and one week after the test using X-rite 310TR manufactured by X-rite. The results are shown in Table 32. It is evident from Table 32 that light fastness is markedly improved in the image forming material which contains the fading inhibitor of the present invention having appropriate water-solubility, in comparison with the image forming material containing no fading inhibitor or the image forming material which contains a water-insoluble fading inhibitor.

When the same test was carried out by adding the fading inhibitor of the present invention to the photosensitive material and processing material, light fastness improving effect was observed.

TABLE 32

Construction of image receiving element and results of light fastness evaluation

| Image receiving element | Example | Fading inhibitor | Amount added mmol/m$^2$ | residual ratio of dye |
|---|---|---|---|---|
| 400 | Comparative | none | — | 55 |
| 401 | Comparative | B-1 | 10 | 57 |
| 402 | Comparative | B-2 | 5 | 53 |
| 403 | Comparative | B-3 | 10 | 57 |
| 404 | Comparative | B-4 | 10 | 54 |
| 405 | Comparative | B-5 | 10 | 63 |
| 406 | Inventive | a-2 | 10 | 73 |
| 407 | Inventive | a-4 | 10 | 78 |
| 408 | Inventive | a-5 | 10 | 79 |
| 409 | Inventive | a-10 | 10 | 75 |
| 410 | Inventive | a-15 | 10 | 73 |
| 411 | Inventive | a-18 | 10 | 74 |
| 412 | Inventive | a-26 | 10 | 77 |
| 413 | Inventive | a-34 | 10 | 75 |
| 414 | Inventive | a-35 | 10 | 75 |
| 415 | Inventive | a-39 | 10 | 72 |
| 416 | Inventive | a-51 | 5 | 73 |
| 417 | Inventive | a-53 | 5 | 77 |
| 418 | Inventive | a-68 | 5 | 72 |
| 419 | Inventive | a-72 | 5 | 75 |
| 420 | Inventive | a-53 | 5 | 75 |
| 500 | Comparative | none | — | 62 |
| 501 | Comparative | B-1 | 10 | 65 |
| 502 | Comparative | B-2 | 5 | 62 |
| 503 | Comparative | B-3 | 10 | 61 |

TABLE 32-continued

Construction of image receiving element and results of light fastness evaluation

| Image receiving element | Example | Fading inhibitor | Amount added mmol/m$^2$ | residual ratio of dye |
|---|---|---|---|---|
| 504 | Comparative | B-4 | 10 | 67 |
| 505 | Comparative | B-5 | 10 | 75 |
| 506 | Inventive | a-2 | 10 | 85 |
| 507 | Inventive | a-4 | 10 | 88 |
| 508 | Inventive | a-5 | 10 | 83 |
| 509 | Inventive | a-10 | 10 | 92 |
| 510 | Inventive | a-26 | 10 | 90 |
| 511 | Inventive | a-52 | 5 | 90 |
| 512 | Inventive | a-53 | 5 | 87 |
| 513 | Inventive | a-55 | 5 | 86 |
| 514 | Inventive | a-66 | 5 | 88 |
| 515 | Inventive | a-67 | 5 | 83 |

Thus, according to the present invention, a method which can suitably improve light fastness of images obtained by a diffusion transfer image forming process is provided, and an image forming material having improved light fastness is also provided.

While the invention has been described in detail and with reference to specific examples thereof, it will be apparent to one skilled in the art that various changes and modifications can be made therein without departing from the spirit and scope thereof.

What is claimed is:

1. A method for forming an image having improved light fastness, which comprises exposing and developing a photosensitive silver halide element containing a diffusible image forming dye or a precursor thereof, and transferring the image forming dye or a precursor thereof to a dye fixing element corresponding or counter-corresponding to silver development and allowing an image formed by transferring said image forming dye or precursor thereof to coexist with a water-soluble compound without a ballast group represented by general formula (I) in said dye fixing element (I)

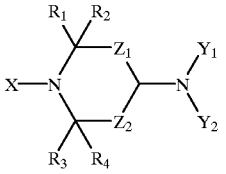

wherein X represents a hydrogen atom, a hydroxyl group, an aliphatic group, an acyl group, an aliphatic oxy group, an aliphatic oxycarbonyl group or an aryloxycarbonyl group, $Y_1$ and $Y_2$ may be the same or different from each other, each representing a hydrogen atom or a substituent group, or may form a five- or six-membered nitrogen-containing hetero ring by linking with each other, $Z_1$ represents a single bond or a methylene or ethylene group which may have a substituent group, $Z_2$ represents a methylene group which may have a substituent group, and $R_1$, $R_2$, $R_3$ and $R_4$ may be the same or different from one another and each represents an aliphatic group wherein each of the combinations of $R_1$ and $R_2$ and $R_3$ and $R_4$ may form a five- or six-membered ring by linking with each other.

2. An image forming material selected from the group consisting of a photosensitive silver halide element containing a diffusible image forming dye or a precursor thereof, a dye fixing element and an aqueous alkaline processing composition, which comprises a water-soluble fading inhibitor or a precursor thereof without a ballast group represented by the following general formula (I):

(I)

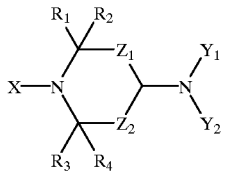

wherein X represents a hydrogen atom, a hydroxyl group, an aliphatic group, an acyl group, an aliphatic oxy group, an aliphatic oxycarbonyl group or an aryloxycarbonyl group, $Y_1$ and $Y_2$ may be the same or different from each other, each representing a hydrogen atom or a substituent group, or may form a five- or six-membered nitrogen-containing hetero ring by linking with each other, $Z_1$ represents a single bond or a methylene or ethylene group which may have a substituent group, $Z_2$ represents a methylene group which may have a substituent group, and $R_1$, $R_2$, $R_3$ and $R_4$ may be the same or different from one another and each represents an aliphatic group wherein each of the combinations of $R_1$ and $R_2$ and $R_3$ and $R_4$ may form a five- or six-membered ring by linking with each other.

3. A dye fixing element for use in a method in which an image forming dye or a precursor thereof is released or formed corresponding or counter-corresponding to silver development and an image is formed by transferring said image forming dye or precursor thereof, which comprises a water-soluble fading inhibitor or a precursor, thereof without a ballast group represented by the following general formula (I):

(I)

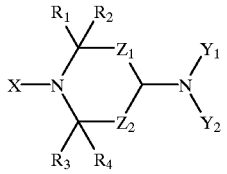

wherein X represents a hydrogen atom, a hydroxyl group, an aliphatic group, an acyl group, an aliphatic oxy group, an aliphatic oxycarbonyl group or an aryloxycarbonyl group, $Y_1$ and $Y_2$ may be the same or different from each other, each representing a hydrogen atom or a substituent group, or may form a five- or six-membered nitrogen-containing hetero ring by linking with each other, $Z_1$ represents a single bond or a methylene or ethylene group which may have a substituent group, $Z_2$ represents a methylene group which may have a substituent group, and $R_1$, $R_2$, $R_3$ and $R_4$ may be the same or different from one another and each represents an aliphatic group wherein each of the combinations of $R_1$ and $R_2$ and $R_3$ and $R_4$ may form a five- or six-membered ring by linking with each other.

4. The dye fixing element according to claim 3, wherein the dye fixing element contains a polymer mordant.

5. The dye fixing element according to claim 4, wherein the polymer mordant contains 60 mol % or more of the unit represented by the following general formula (II):

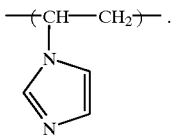

6. A dye fixing element for use in a system in which a photosensitive element containing at least a photosensitive silver halide is imagewise exposed, and laminated, simultaneously with or after the imagewise exposure, with a dye fixing element comprising a separate support from that of the photosensitive element in the presence of at least one of a base and a base precursor together with a small amount of water, and the laminated elements are subjected to heat development to form a transfer dye image on the dye fixing element, which fixing element comprises a polymer mordant and a water-soluble fading inhibitor or a precursor thereof without a ballast group represented by the following general formula (I):

(I)

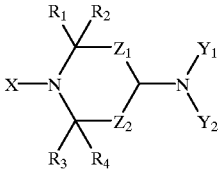

wherein X represents a hydrogen atom, a hydroxyl group, an aliphatic group, an acyl group, an aliphatic oxy group, an aliphatic oxycarbonyl group or an aryloxycarbonyl group, $Y_1$ and $Y_2$ may be the same or different from each other, each representing a hydrogen atom or a substituent group, or may form a five- or six-membered nitrogen-containing hetero ring by linking with each other, $Z_1$ represents a single bond or a methylene or ethylene group which may have a substituent group, $Z_2$ represents a methylene group which may have a substituent group, and $R_1$, $R_2$, $R_3$ and $R_4$ may be the same or different from one another and each represents an aliphatic group wherein each of the combinations of $R_1$, and $R_2$ and $R_3$ and $R_4$ may form a five- or six-membered ring by linking with each other.

7. The dye fixing element according to claim 3, wherein the image forming dye is a phenol azo dye.

8. The dye fixing element according to claim 4, wherein the image forming dye is a phenol azo dye.

9. The dye fixing element according to claim 5, wherein the image forming dye is a phenol azo dye.

10. The dye fixing element according to claim 6, wherein the image forming dye is a phenol azo dye.

11. The method according to claim 1, wherein $Y_1$ is a hydrogen atom and $Y_2$ is selected from the group consisting of an acyl group, an aliphatic oxycarbonyl group, an aryloxycarbonyl group, a carbamoyl group, a sulfamoylcarbamoyl group, an aliphatic sulfonyl group, an arylsulfonyl group, a sulfamoyl group, a phosphoryl group and a phosphonyl group.

12. The image forming material according to claim 2, wherein $Y_1$ is a hydrogen atom and $Y_2$ is selected from the group consisting of an acyl group, an aliphatic oxycarbonyl group, an aryloxycarbonyl group, a carbamoyl group, a sulfamoylcarbamoyl group, an aliphatic sulfonyl group, an arylsulfonyl group, a sulfamoyl group, a phosphoryl group and a phosphonyl group.

13. The dye fixing element according to claim 3, wherein $Y_1$ is a hydrogen atom and $Y_2$ is selected from the group consisting of an acyl group, an aliphatic oxycarbonyl group, an aryloxycarbonyl group, a carbamoyl group, a sulfamoylcarbamoyl group, an aliphatic sulfonyl group, an arylsulfonyl group, a sulfamoyl group, a phosphoryl group and a phosphonyl group.

14. The dye fixing element according to claim 6, wherein $Y_1$ is a hydrogen atom and $Y_2$ is selected from the group consisting of an acyl group, an aliphatic oxycarbonyl group, an aryloxycarbonyl group, a carbamoyl group, a sulfamoylcarbamoyl group, an aliphatic sulfonyl group, an arylsulfonyl group, a sulfamoyl group, a phosphoryl group and a phosphonyl group.

15. The method according to claim 1, wherein said water-soluble compound represented by general formula (I) is a compound represented by general formula (I-1) or general formula (I-2):

(I-1)

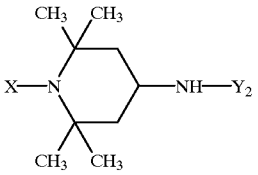

(I-2)

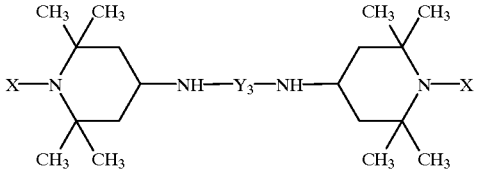

wherein X and $Y_2$ are as defined in general formula (I); and $Y_3$ is a single bond or a divalent group.

16. The image forming material according to claim 2, wherein said water-soluble compound represented by general formula (I) is a compound represented by general formula (I-1) or general formula (I-2):

(I-1)

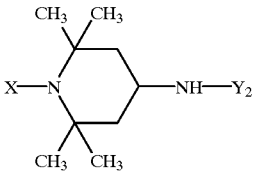

(I-2)

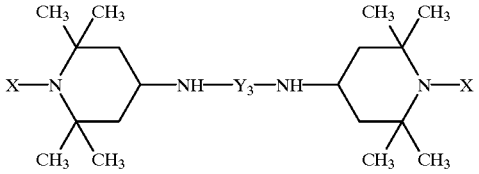

wherein X and $Y_2$ are as defined in general formula (I); and $Y_3$ is a single bond or a divalent group.

17. The dye fixing element according to claim 3, wherein said water-soluble compound represented by general formula (I) is a compound represented by general formula (I-1) or general formula (I-2):

(I-1)

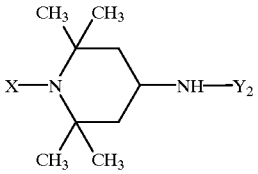

(I-2)

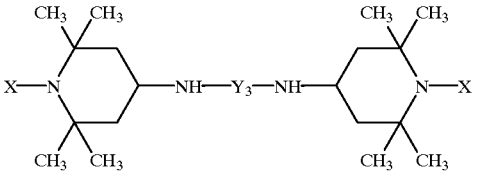

wherein X and $Y_2$ are as defined in general formula (I); and $Y_3$ is a single bond or a divalent group.

18. The dye fixing element according to claim 6, wherein said water-soluble compound represented by general formula (I) is a compound represented by general formula (I-1) or general formula (I-2)

(I-1)

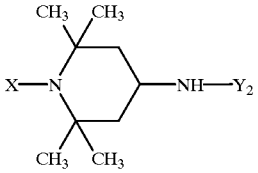

(I-2)

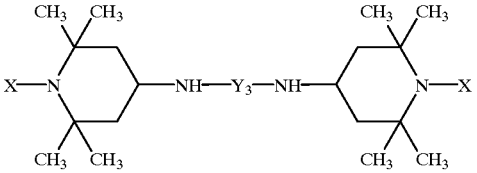

wherein X and $Y_2$ are as defined in general formula (I); and $Y_3$ is a single bond or a divalent group.

* * * * *